US007101026B2

(12) United States Patent
Shimada et al.

(10) Patent No.: US 7,101,026 B2
(45) Date of Patent: Sep. 5, 2006

(54) INK JET RECORDING HEAD AND INK JET RECORDER HAVING A COMPRESSION FILM WITH A COMPRESSIVE STRESS AND REMOVAL PART INCORPORATED THEREIN

(75) Inventors: Masato Shimada, Nagano (JP); Shinri Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/199,816

(22) Filed: Nov. 25, 1998

(65) Prior Publication Data

US 2002/0080213 A1 Jun. 27, 2002

(30) Foreign Application Priority Data

| | | |
|---|---|---|
| Nov. 25, 1997 | (JP) | 9-323010 |
| Apr. 8, 1998 | (JP) | 10-096406 |
| May 22, 1998 | (JP) | 10-140684 |
| Jun. 8, 1998 | (JP) | 10-159354 |
| Jul. 22, 1998 | (JP) | 10-207004 |
| Nov. 2, 1998 | (JP) | 10-312368 |

(51) Int. Cl.
*B41J 2/045* (2006.01)

(52) U.S. Cl. ..... 347/68; 347/71; 347/72

(58) Field of Classification Search ..... 347/68, 347/79, 71, 72; 310/328, 333, 330, 331, 310/364, 365; 216/27, 57; 438/21, 704; 204/192.23; 257/295; 250/306
See application file for complete search history.

(56) References Cited

U.S. PATENT DOCUMENTS 5,124,716 A * 6/1992 Roy et al. ..... 347/70
5,212,496 A * 5/1993 Badesha et al. ..... 347/70
5,265,315 A 11/1993 Hoisington et al. ..... 29/25.35
5,376,857 A * 12/1994 Takeuchi et al. ..... 310/328
5,530,465 A * 6/1996 Hasegawa et al. ..... 347/70
5,610,643 A * 3/1997 Kutami et al. ..... 347/70
5,631,463 A * 5/1997 Kawasaki et al. ..... 250/306
5,719,607 A * 2/1998 Hasegawa et al. ..... 347/70
5,831,299 A * 11/1998 Yokoyama et al. ..... 257/295

(Continued)

FOREIGN PATENT DOCUMENTS

EP 0 718 900 6/1996

(Continued)

OTHER PUBLICATIONS

Stress-Strength (Mechanis) of Materials, Engineers Edge, 2005.*

(Continued)

*Primary Examiner*—Hai Pham
*Assistant Examiner*—Lam S. Nguyen
(74) *Attorney, Agent, or Firm*—Sughrue Mion, PLLC

(57) ABSTRACT

To provide an ink jet recording head with a decreased initial deflection amount of a diaphragm and an ink jet recorder comprising the ink jet recording head. An ink jet recording head which has a flow passage formation substrate 10 where pressure generation chambers 12 communicating with nozzle openings are defined and a piezoelectric element being placed on one side of the flow passage formation substrate 10 via a diaphragm and having at least a lower electrode 60, a piezoelectric layer 70, and an upper electrode 80, characterized in that at least one of layers deposited together with the piezoelectric layer 70 is a compression film 50 having a compressive stress and the compression film 50 has at least a part in a thickness direction removed in at least a part of an area opposed to the pressure generation chamber, whereby the stress of the whole film is decreased.

58 Claims, 23 Drawing Sheets

U.S. PATENT DOCUMENTS

| | | | | |
|---|---|---|---|---|
| 5,984,458 | A | 11/1999 | Murai | |
| 6,022,458 | A * | 2/2000 | Ichikawa | 204/192.23 |

FOREIGN PATENT DOCUMENTS

| | | |
|---|---|---|
| EP | 0 786 345 | 7/1997 |
| JP | 040187411 | 6/1992 |
| JP | 05084904 | 6/1993 |
| JP | 6-293999 A | 10/1994 |
| JP | 07178906 | 7/1995 |
| JP | 7-245237 | 9/1995 |
| JP | 8-58088 | 5/1996 |
| JP | 8-153854 A | 6/1996 |
| JP | 9-116111 | 5/1997 |
| JP | 9-232644 A | 9/1997 |
| JP | 10100421 | 4/1998 |
| JP | A-11-138807 | 5/1999 |
| WO | WO 9818632 | 5/1998 |

OTHER PUBLICATIONS

Compressive stress, Wikipedia, Mar. 24, 2005.*

* cited by examiner

INK JET RECORDING HEAD AND INK JET RECORDER HAVING A COMPRESSION FILM WITH A COMPRESSIVE STRESS AND REMOVAL PART INCORPORATED THEREIN

BACKGROUND OF THE INVENTION

1. Field of the Invention

This invention relates to an ink jet recording head wherein some of the pressure generation chambers communicating with nozzle openings for jetting ink drops are formed of a diaphragm and the diaphragm is formed on a surface with a piezoelectric element for jetting ink drops by displacement of the piezoelectric element, and an ink jet recorder comprising the ink jet recording head.

2. Description of the Related Art

The following two types of ink jet recording heads, each wherein a part of a pressure generation chamber communicating with a nozzle opening for jetting an ink drop is formed of a diaphragm and the diaphragm is deformed by a piezoelectric element for pressurizing ink in the pressure generation chamber for jetting an ink drop from the nozzle opening, are commercially practical: One uses a piezoelectric actuator in a vertical vibration mode in which a piezoelectric element is expanded and contracted axially and the other uses a piezoelectric element in a deflection vibration mode.

With the former, the volume of the pressure Generation chamber can be chanced by abutting an end face of the piezoelectric element against the diaphragm and heads appropriate for high-density printing can be manufactured. However, in this example, a difficult step of dividing the piezoelectric element into comb-like teeth which match the arrangement pitch of the nozzle openings and positioning and fixing the piezoelectric element divisions in the pressure generation chambers are required and the manufacturing process is complicated.

In contrast, with the latter, the piezoelectric element can be created and attached to the diaphragm by executing a comparatively simple process of putting a green sheet of a piezoelectric material matching the form of the pressure generation chamber and calcining it, but a reasonable area is required because deflection vibration is used. Accordingly, high-density arrangement is difficult to make.

On the other hand, to solve the problem of the latter recording head. Japanese Patent Laid-Open No. Hei 5-286131 proposes an art wherein uniform piezoelectric material layer is formed over the entire surface of a diaphragm according to a film formation technique and is divided to a form corresponding to a pressure generation chamber according to a lithography technique for forming a piezoelectric element independently for each pressure generation chamber.

This eliminates the need to place the piezoelectric element on the diaphragm and the piezoelectric element can be created by an accurate and simple technique of lithography method. In addition, the piezoelectric element can be thinned and high-speed drive is enabled.

However, in the manufacturing method according to the lithograph method and the thin-film technique described above, after thin film patterning, pressure generation chambers are formed. At that time, a diaphragm is deflected to the pressure generation chamber side by the effect of easing the internal stresses of the upper electrode and piezoelectric layers and the deflection remains as the initial deformation of the diaphragm. Particularly, if the lower electrode is overetched, the deflection amount is large and the diaphragm deformation amount by driving a piezoelectric actuator becomes smaller than the calculation value. The possible reason is that the diaphragm is deflected by the effect of easing the internal stresses of the upper electrode and piezoelectric layers (and the lower electrode) in the tension direction and thus a plastic deformation area is reached beyond an elastic deformation area. In addition to a diaphragm containing a silicon oxide film, a diaphragm containing a zirconium oxide film as a highly rigid diaphragm is proposed as the diaphragm, but similar initial deformation occurs in any diaphragms.

SUMMARY OF THE INVENTION

It is therefore an object of the invention to provide an ink jet recording head with the initial deflection amount of a diaphragm decreased and an ink jet recorder comprising the ink jet recording head.

To the end, according to a first form of the invention, there is provided an ink jet recording head comprising a flow passage formation substrate where pressure generation chambers communicating with nozzle openings are defined, a piezoelectric element being placed on one side of the flow passage formation substrate via a diaphragm and having at least a lower electrode, a piezoelectric layer, and an upper electrode, characterized in that at least one of layers deposited together with the piezoelectric layer is a compression film having a compressive stress and the compression film has at least a part in a thickness direction removed in at least a part of an area opposed to the pressure generation chamber.

In the first form of the invention, the initial deflection amount of the diaphragm is decreased by the stress released by compression film patterning when the pressure generation chambers are formed.

In a second form of the invention, in the ink jet recording head in the first form, the compression film has at least a part in the thickness direction removed in an area which is opposed to the pressure generation chamber and is other than the piezoelectric layer.

In the second form of the invention, the initial deflection amount of the diaphragm is decreased by the stress released by compression film patterning.

In a third form of the invention, in the ink jet recording head in the first or second form, the compression film has at least a part in the thickness direction removed only in a portion along margins of the pressure generation chamber on both sides of the piezoelectric element in the width direction thereof In the third form of the invention, the initial deflection amount of the diaphragm is decreased by removing the compression film at the minimum.

In a fourth form of the invention, in the ink jet recording head in any one of the first to third forms, the compression film is a conductive film being placed between the lower electrode and the piezoelectric layer and made of a material substantially different from that of the lower electrode.

In the fourth form of the invention, the initial deflection amount of the diaphragm is decreased by the stress released by conductive film patterning.

In a fifth form of the invention, in the ink jet recording head in the fourth form, the conductive film is a film containing a first conductive film formed on the lower electrode and a second conductive film formed on the first conductive film and at least the first conductive film is a film made of a material different from that of the lower electrode.

In the fifth form of the invention, in the manufacturing process, the residual stress occurring between the layers can be decreased.

In a sixth form of the invention, in the ink jet recording head in the fifth form, the second conductive film is a film consisting essentially of either platinum or iridium.

In the sixth form of the invention, the second conductive film is formed of a film consisting essentially of a specific metal, whereby the residual stress is decreased reliably.

In a seventh form of the invention, in the ink jet recording head in the fifth or sixth form, the first conductive film is a metal oxide film.

In the seventh form of the invention, the first conductive film is formed of a metal oxide film, whereby the residual stress is decreased reliably.

In an eighth form of the invention, in the ink jet recording head in any one of the fifth to seventh forms, the first conductive film is a film formed of a material for preventing lead contained in the piezoelectric layer from diffusing.

In the eighth form of the invention, diffusion of lead into the piezoelectric layer is prevented and degradation of the piezoelectric characteristic of the piezoelectric layer is prevented.

In a ninth form of the invention, in the ink jet recording head in any one of the fifth to eighth forms, the first conductive film consists essentially of any of iridium oxide, rhenium oxide, or ruthenium oxide.

In the ninth form of the invention, the first conductive film is formed of a specific material, whereby the residual stress is decreased reliably.

In a tenth form of the invention, in the ink jet recording head in any one of the first to ninth forms, the compression film forms at least a part of an elastic film forming at least a part of the diaphragm.

In the tenth form of the invention, the initial deflection amount of the diaphragm is decreased by the stress released by compression film patterning.

In an eleventh form of the invention, in the ink jet recording head in the tenth form, at least the residue of the compression film forming a part of the elastic film is made of a polycrystalline substance.

In the eleventh form of the invention, the rigidity of the residue is enhanced.

In a twelfth form of the invention, in the ink jet recording head in the tenth or eleventh form, the elastic film is made of the compression film only.

In the twelfth form of the invention, the initial deflection is decreased by the stress released as a part of the compression film is removed.

In a thirteenth form of the invention, in the ink jet recording head in the tenth or eleventh form, the elastic film is made of a film of multiple layers and at least the top layer is the compression film.

In the thirteenth form of the invention, the compressive stress is released by top layer patterning and the initial deflection is decreased.

In a fourteenth form of the invention, in the ink jet recording head in any one of the tenth to thirteenth forms, the compression film forming the elastic film is made of metal oxide.

In the fourteenth form of the invention, a film having a compressive stress is formed of a metal oxide and when the pressure generation chambers are formed, downward deformation of the diaphragm can be prevented effectively.

In a fifteenth form of the invention, in the ink jet recording head in the fourteenth form, the compression film is made of zirconium oxide or hafnium oxide and has a crystal structure of a monoclinic system.

In the fifteenth form of the invention, the compression film is made a film of a monoclinic system, whereby it can be made of a film having a compressive stress.

In a sixteenth form of the invention, in the ink jet recording head in any one of the thirteenth to fifteenth forms, a layer below the compression film is a layer made of a material different from the compression film in etching characteristic and not selectively etched.

In the sixteenth form of the invention, compression film patterning can be executed easily.

In a seventeenth form of the invention, in the ink jet recording head in the fifteenth form, the not selectively etched layer below the compression film is selected from the group consisting of metal, stabilization or partial stabilization zirconium oxide, and stabilization or partial stabilization hafnium oxide.

In the seventeenth form of the invention, compression film etching can be executed easily because of the difference in etching property.

In an eighteenth form of the invention, in the ink jet recording head in any one of the tenth to seventeenth forms, the lower electrode is made of a film having a tensile stress and is thinner than the compression film of the portion with at least a part removed.

In the eighteenth form of the invention, the compressive stress released by compression film patterning becomes larger than the tensile stress released by lower electrode patterning, and the initial deflection amount is decreased.

In a nineteenth form of the invention, in the ink jet recording head in any one of the thirteenth to eighteenth forms, the elastic film contains a silicon dioxide film or a boron-doped silicon film on the pressure generation chamber side.

In the nineteenth form of the invention, the elastic film containing a silicon dioxide film serves as the diaphragm.

In a twentieth form of the invention, in the ink jet recording head in any one of the first to nineteenth forms, the lower electrode is made of the compression film.

In the twentieth form of the invention, when the pressure generation chambers are formed, the piezoelectric layer is pulled outward in the width direction by the force of releasing the stress of the lower electrode, and the piezoelectric characteristic is improved.

In a twenty-first form of the invention, in the ink jet recording head in the twentieth form, the lower electrode is made of a metal material.

In the twenty-first form of the invention, the lower electrode is formed of a metal material, whereby a compressive stress is provided and the piezoelectric characteristic can be improved.

In a twenty-second form of the invention, in the ink jet recording head in the twentieth form, the lower electrode is made of metal oxide.

In the twenty-second form of the invention, the lower electrode is formed of metal oxide, whereby a compressive stress is provided and the piezoelectric characteristic can be improved.

In a twenty-third form of the invention, in the ink jet recording head in the twentieth form, the lower electrode is made of metal nitride.

In the twenty-third form of the invention, the lower electrode is formed of metal nitride, whereby a compressive stress is provided and the piezoelectric characteristic can be improved.

In a twenty-fourth form of the invention, in the ink jet recording head in any one of the twentieth to twenty-third forms, the lower electrode on both sides of the piezoelectric layer in the width direction thereof is completely removed.

In the twenty-fourth form of the invention, the compressive stress of the lower electrode is all released in the thickness direction and the initial deflection amount of the diaphragm can be decreased.

In a twenty-fifth form of the invention, in the ink jet recording head in any one of the first to twenty-fourth forms, the upper electrode is formed of the compression film and is patterned together with the piezoelectric layer.

In the twenty-fifth form of the invention, when the pressure generation chambers are formed, the diaphragm receives a stress in the tension direction from the upper electrode and is prevented from becoming deformed downward.

In a twenty-sixth form of the invention, in the ink jet recording head in the twenty-fifth form, the upper electrode made of the compression film has a compressive stress at least after the piezoelectric element is patterned.

In the twenty-sixth form of the invention, when the pressure generation chambers are formed, the diaphragm receives a stress in the tension direction from the upper electrode and is prevented from becoming deformed downward.

In a twenty-seventh form of the invention, in the ink jet recording head in the twenty-sixth form, the upper electrode consists essentially of a metal material.

In the twenty-seventh form of the invention, the upper electrode is formed of a metal material, whereby a compressive stress can be provided.

In a twenty-eighth form of the invention, in the ink jet recording head in the twenty-seventh form, the upper electrode made of the compression film is formed by a sputtering method and a predetermined gas is added into the metal material, whereby the upper electrode becomes subject to a compressive stress.

In the twenty-eighth form of the invention, the upper electrode can be given a compressive stress easily without increasing the complexity of the manufacturing process.

In a twenty-ninth form of the invention, in the ink jet recording head in the twenty-eighth form, the predetermined gas is an inert gas selected from the group consisting of helium, neon, argon, krypton, xenon, and radon.

In the twenty-ninth form of the invention, gas does not react with the upper electrode and a compressive stress can be given to the upper electrode.

In a thirtieth form of the invention, in the ink jet recording head in the twenty-seventh form, at least one additive selected from the group consisting of metal, semimetal, semiconductor, and insulator different in composition is added into the metal material, whereby the upper electrode made of the compression film becomes subject to a compressive stress.

In the thirtieth form of the invention, a stronger compressive stress can be given to the upper electrode.

In a thirty-first form of the invention, in the ink jet recording head in the thirtieth form, the additive is added to the upper electrode by executing ion implantation.

In the thirty-first form of the invention, more additive is added to the upper layer side of the upper electrode, so that the upper layer side becomes subject to a stronger compressive stress.

In a thirty-second form of the invention, in the ink jet recording head in the thirtieth form, the additive is added to the upper electrode by executing solid-phase diffusion from a layer placed on the upper electrode.

In the thirty-second form of the invention, more additive is added to the upper layer side of the upper electrode, so that the upper layer side becomes subject to a stronger compressive stress.

In a thirty-third form of the invention, in the ink jet recording head in the thirtieth form, the solid-phase diffusion is executed by heating in an insert gas or in a vacuum.

In the thirty-third form of the invention, the solid-phase diffusion can be comparatively easily executed by heating in an insert gas or vacuum.

In a thirty-fourth form of the invention, in the ink jet recording head in the twenty-fifth or twenty-sixth form, the upper electrode has a first electrode formed on a surface of the piezoelectric layer and a second electrode deposited on the first electrode and the second electrode is a film made of metal oxide or metal nitride.

In the thirty-fourth form of the invention, the upper layer of the upper electrode is formed of an oxide film having a stronger compressive stress than the lower layer and when the pressure generation chambers are formed, the diaphragm is deformed upward effectively.

In a thirty-fifth form of the invention, in the ink jet recording head in the thirty-fourth form, the first electrode consists essentially of a metal material.

In the thirty-fifth form of the invention, the first electrode is formed of a metal material, whereby a compressive stress can be provided.

In a thirty-sixth form of the invention, in the ink jet recording head in any one of the twenty-first to thirty-fifth forms, the metal material is selected from the group consisting of platinum, palladium, iridium, rhodium, osmium, ruthenium, and rhenium, and compounds thereof.

In the thirty-sixth form of the invention, the upper layer of the upper electrode is formed of an oxide film, whereby a stronger compressive stress than that of the lower layer can be provided and when the pressure generation chambers are formed, the diaphragm can be prevented effectively from becoming downward deformed.

In a thirty-seventh form of the invention, in the ink jet recording head in any one of the fourteenth to thirty-sixth forms, the metal oxide is selected from the group consisting of ruthenium oxide, indium oxide tin, cadmium indium oxide, tin oxide, manganese oxide, rhenium oxide, iridium oxide, strontium ruthenium oxide, indium oxide, zinc oxide, titanium oxide, zirconium oxide, tantalum oxide, hafnium oxide, osmium oxide, rhodium oxide, palladium oxide, and molybdenum oxide, and compounds thereof.

In the thirty-seventh form of the invention, the film is formed of a specific metal oxide, whereby a compressive stress can be given to the film.

In a thirty-eighth form of the invention, in the ink jet recording head in any one of the twenty-third to thirty-sixth forms, the metal nitride is selected from the group consisting of titanium nitride, niobium nitride, zirconium nitride, tungsten nitride, hafnium nitride, molybdenum nitride, tantalum nitride, chromium nitride, and palladium nitride, and compounds thereof.

In the thirty-eighth form of the invention, the film is formed of a specific metal nitride, whereby a compressive stress can be given to the film.

In a thirty-ninth form of the invention, in the ink jet recording head in the thirty-seven or thirty-eighth form, layers formed of the metal oxide and the metal nitride are formed by oxidation or nitriding after film formation.

In the thirty-ninth form of the invention, the layers formed of the metal oxide and the metal nitride can be formed easily.

In a fortieth form of the invention, in the ink jet recording head in any one of the first or thirty-ninth forms, the elastic film forming at least a part of the diaphragm has at least a part in the thickness direction removed in an area which is opposed to the pressure generation chamber and is other than the piezoelectric layer.

In the fortieth form of the invention, a part of the elastic film is removed, whereby compliance of the elastic film increases and the deformation amount of the diaphragm by driving the piezoelectric element grows.

In a forty-first form of the invention, in the ink jet recording head in the fortieth form, the elastic film has at least a part in the thickness direction removed only in a portion along the margins of the pressure generation chamber on both sides of the piezoelectric element in the width direction thereof.

In the forty-first form of the invention, a part of the elastic film is removed, whereby compliance of the elastic film increases and the deformation amount of the diaphragm by driving the piezoelectric element grows.

In a forty-second form of the invention, in the ink jet recording head in the fortieth or forty-first form, the piezoelectric element is formed on the elastic film so as to extend to the portion with at least a part of the elastic film removed.

In the forty-second form of the invention, a position shift of the piezoelectric active part in the width direction thereof is prevented.

In a forty-third form of the invention, in the ink jet recording head in the forty-second form, the piezoelectric layer forming the piezoelectric element is roughly uniformly thick.

In the forty-third form of the invention, a position shift of the piezoelectric active part in the width direction thereof is prevented.

In a forty-fourth form of the invention, in the ink jet recording head in the forty-second form, an end of the extension of the piezoelectric layer forming the piezoelectric element adjacent to the portion with the part of the elastic film removed is thicker than other portions.

In the forty-fourth form of the invention, the electric break down at the end of the piezoelectric active part in the width direction thereof is suppressed.

In a forty-fifth form of the invention, in the ink jet recording head in any one of the fortieth to forty-fourth forms, at least a part of the piezoelectric layer is formed across an area opposed to the pressure generation chamber and the piezoelectric element is formed by patterning only the upper electrode or the upper electrode and a part of the piezoelectric layer in the thickness direction thereof.

In the forty-fifth form of the invention, the piezoelectric element is formed by patterning only the upper electrode, or the upper electrode and a part of the piezoelectric layer in the thickness direction thereof.

In a forty-sixth form of the invention, in the ink jet recording head in any one of the fortieth to forty-fifth forms, the lower electrode is placed uniformly in an area opposed to the piezoelectric element and in other areas.

In the forty-sixth form of the invention, the lower electrode is not removed, thus the initial deflection amount of the elastic film caused by the residual stress can be suppressed.

In a forty-seventh form of the invention, in the ink jet recording head in any one of the first to forty-sixth forms, the diaphragm is deformed convex outwardly from the pressure generation chamber.

In the forty-seventh form of the invention, the diaphragm is deformed on the opposite side to ink jetting in the initial state, thus the deformation amount of the diaphragm for ink jetting grows.

In a forty-eighth form of the invention, in the ink jet recording head in any one of the first to forty-seventh forms, a stress of the piezoelectric layer when a drive force load is imposed on the piezoelectric element is equal to a stress at the piezoelectric layer formation time or is larger in a tension direction.

In a forty-ninth form of the invention, in the ink jet recording head in the forty-eighth form, the piezoelectric element in the area opposed to the pressure generation chamber is bent convex to the piezoelectric layer side when the pressure generation chamber is formed.

In the forty-ninth form of the invention, the piezoelectric characteristic of the piezoelectric layer and the displacement amount of the diaphragm are improved and the exclusion volume grows.

In a fiftieth form of the invention, in the ink jet recording head in the forty-eighth or forty-ninth form, the expansion force of a portion of the diaphragm opposed to the piezoelectric element in the area opposed to the pressure generation chamber is relatively smaller than the expansion force in the area not opposed to the piezoelectric element.

In the fiftieth form of the invention, the piezoelectric characteristic of the piezoelectric layer forming a part of the piezoelectric element is improved and the displacement amount of the diaphragm increases.

In a fifty-first form of the invention, in the ink jet recording head in any one of the first to fiftieth forms, the pressure generation chambers are formed on a silicon monocrystalline substrate by anisotropic etching and the layers of the piezoelectric-element are formed by a film forming and lithography process.

In the fifty-first form of the invention, ink jet recording heads each having high-density nozzle openings can be manufactured in large quantity and comparatively easily.

According to a fifty-second form of the invention, there is provided an ink jet recorder comprising an ink jet recording head in any one of the first to fifty-first forms.

In the fifty-second form of the invention, the ink jet recorder having the head improved in ink jetting performance can be provided.

BRIEF DESCRIPTION OF THE DRAWINGS

Referring now to the accompanying drawings, there are shown preferred embodiments of the invention.

In the accompanying drawings.

DESCRIPTION OF THE PREFERRED EMBODIMENTS

Figure 1:
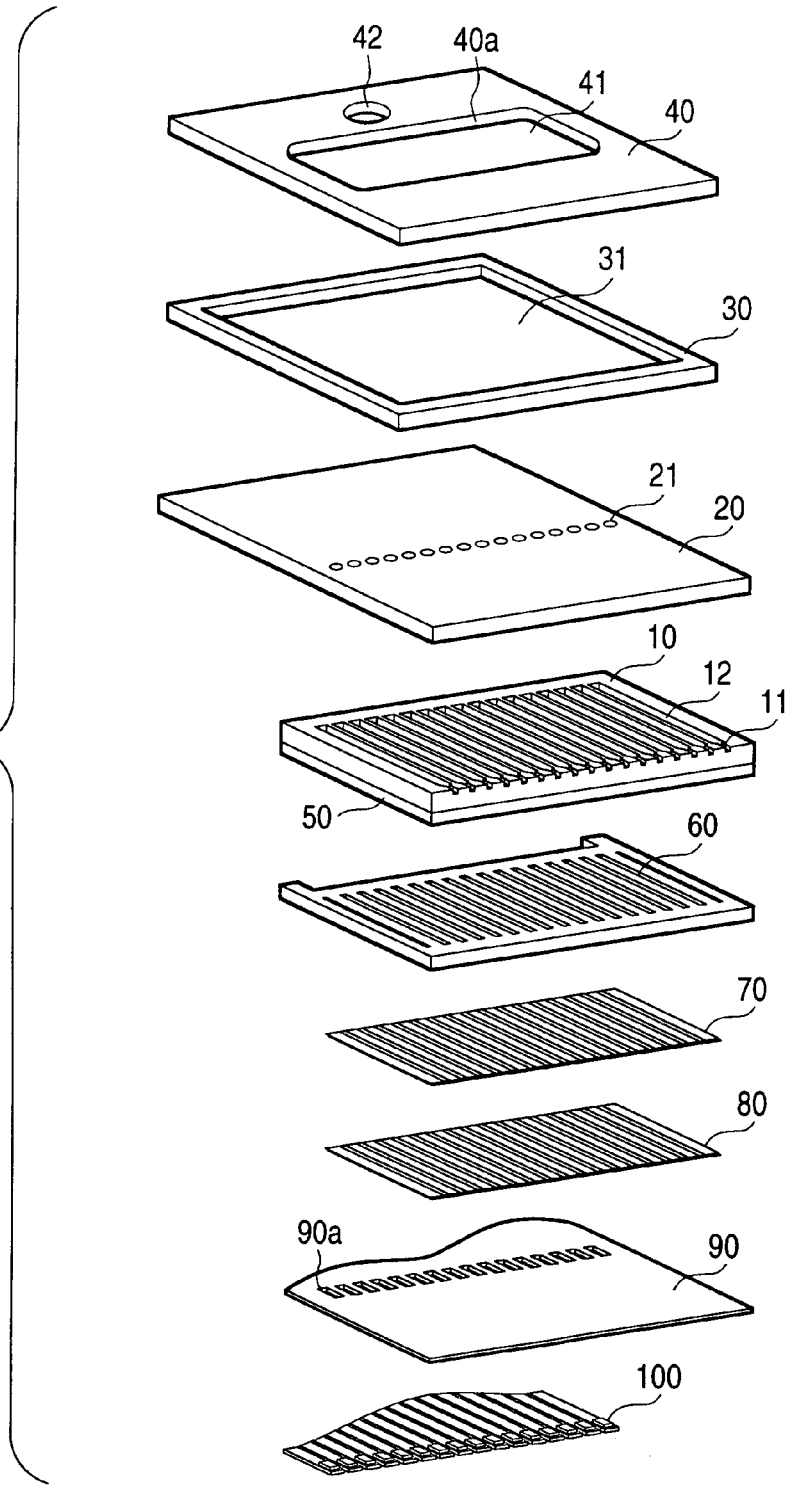
FIG. 1 is an exploded perspective view of an ink jet recording head according to a first embodiment of the invention.
Figure 2:
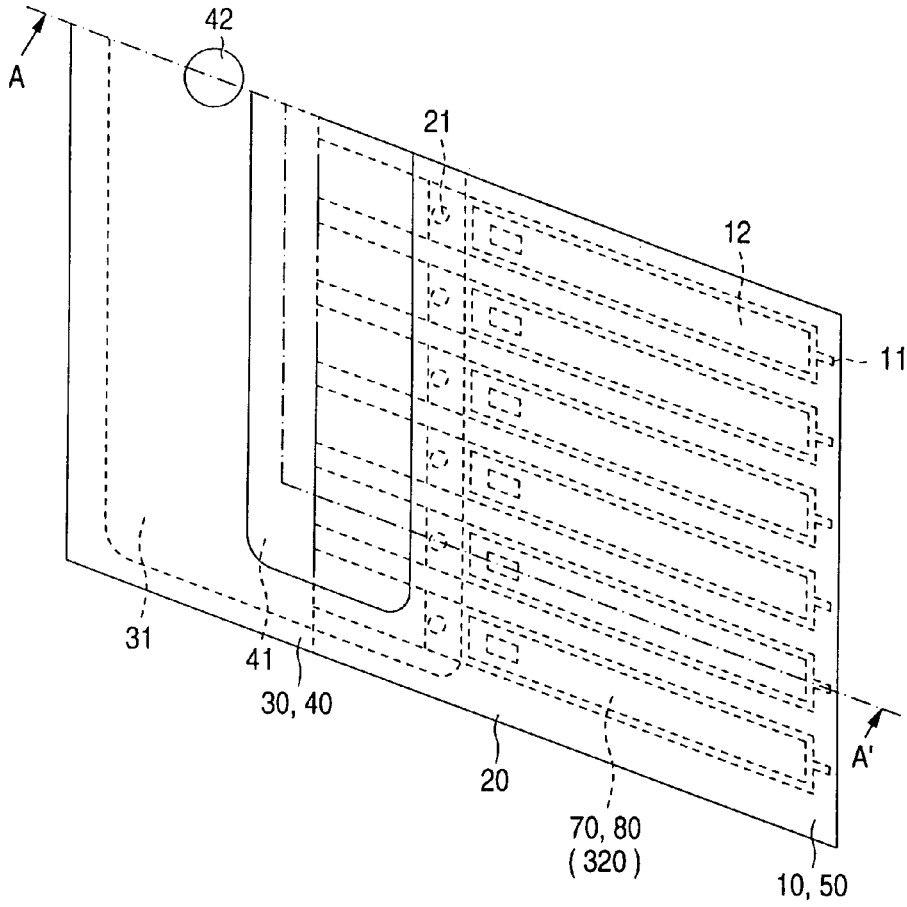
FIGS. 2(*a*)–2(*b*) are plan views and a sectional view of FIG. 1 to show the ink jet recording head according to the first embodiment of the invention.
Figure 2:
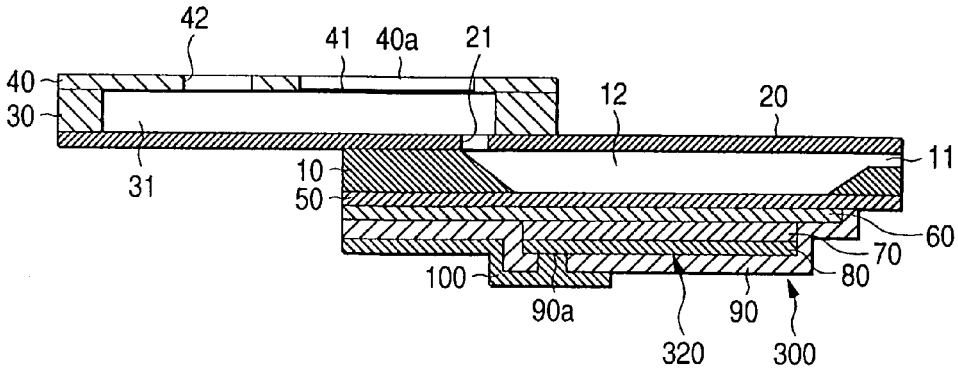

FIG. 1 is an exploded perspective view showing an ink jet recording head according to a first embodiment of the invention and FIG. 2 is a plan view of FIG. 1 and a view to show the sectional structure in the length direction of one pressure generation chamber.

As shown in the figure, a flow passage formation substrate 10 is made of a silicon monocrystalline substrate of a <110> orientation in the embodiment. Normally, a substrate about 150–300 μm thick is used as the flow passage formation substrate 10; preferably a substrate about 180–280 μm thick is used; more preferably a substrate about 220 μm thick is used because the arrangement density can be made high while the rigidity of a partition between contiguous pressure generation chambers is maintained.

The flow passage formation substrate 10 is formed on one face with an opening face and on an opposite face with an elastic film 50 of 0.2–3.0 μm thick made of zirconium oxide having a compressive stress formed by forming a zirconium film and then thermally oxidizing it, for example.

On the other hand, the flow passage formation substrate 10 is formed on the opening face with nozzle openings 11 and pressure generation chambers 12 by anisotropically etching the silicon monocrystalline substrate.

The anisotropic etching is executed by using the nature that if the silicon monocrystalline substrate is immersed in an alkaline solution such as KOH, it gradually erodes, a first <111> plane perpendicular to a <110> plane and a second <111> plane formed about 70 degrees with the first <111> plane and about 35 degrees with the <110> plane appear, and the etching rate of the <111> plane is about 1/180 that of the <110> plane. By the anisotropic etching, accurate work can be executed based on depth work of a parallelogram formed by the two first <111> planes and the two second <111> planes tilted, and the pressure generation chambers 12 can be arranged at a high density.

In the embodiment, the long sides of each pressure generation chambers 12 are formed by the first <111> planes and the short sides are formed by the second <111> planes. The pressure generation chambers 12 are formed by etching the silicon monocrystalline substrate to the elastic film 50. The amount of immersion of the elastic film 50 in the alkaline solution for etching the silicon monocrystalline substrate is extremely small.

On the other hand, each nozzle opening 11 communicating with one end of each pressure generation chambers 12 is formed narrower and shallower than the pressure generation chambers 12. That is, the nozzle openings 11 are made by etching the silicon monocrystalline substrate to an intermediate point in the thickness direction (half etching). The half etching is executed by adjusting the etching time.

The size of each pressure generation chamber 12 for giving ink drop jet pressure to ink and the size of each nozzle opening 11 for jetting ink drops are optimized in response to the jetted ink drop amount, jet speed, and jet frequency. For example, to record 360 ink drops per inch, the nozzle opening 11 needs to be made with accuracy with a groove width of several ten μm.

The pressure generation chambers 12 and a common ink chamber 31 described later are made to communicate with each other via ink supply communication ports 21 formed at positions of a seal plate 20 described later corresponding to ends of the pressure generation chambers 12. Ink is supplied from the common ink chamber 31 through the ink supply communication ports 21 to the pressure generation chambers 12.

Figure 3:
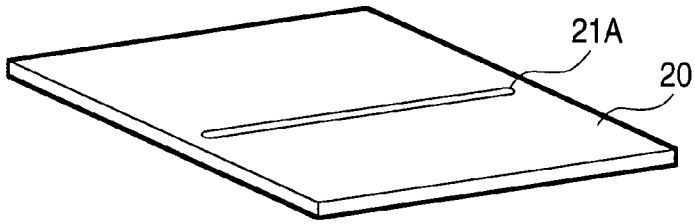
FIGS. 3(*a*)–3(*b*) are perspective views to show modified examples of a seal plate in FIG. 1.
Figure 3:
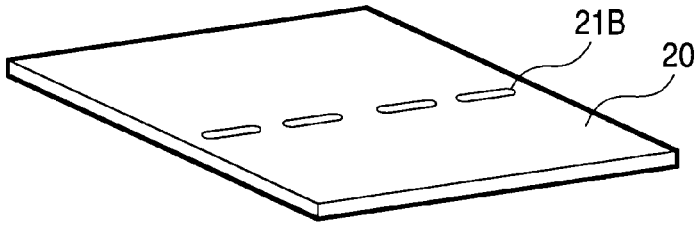

The seal plate is made of glass ceramic having a thickness of 0.1–1 mm and a linear expansion coefficient of 2.5–4.5 [$\times 10^{-6}$/° C.] at 300° C. or less, for example, formed with the ink supply communication ports 21 corresponding to the pressure generation chambers 12. The ink supply communication ports 21 may be one slit hole 21A crossing the neighborhood of the ink supply side ends of the pressure generation chambers 12 as shown in FIG. 3*a* or a plurality of slit holes 21B as shown in FIG. 3*b*. One face of the seal plate 20 covers fully one face of the flow passage formation substrate 10, namely, the seal plate 20 also serves as a reinforcing plate for protecting the silicon monocrystalline substrate from shock and external force. An opposite face of the seal plate 20 forms one wall face of the common ink chamber 31.

A common ink chamber formation substrate 30 forms peripheral wall of the common ink chamber 31; it is made by stamping a stainless steel plate having a proper thickness responsive to the number of nozzle openings and the ink drop jet frequency. In the embodiment, the common ink chamber formation substrate 30 is 0.2 mm thick.

An ink chamber side plate 40 is made of a stainless substrate and one face thereof forms one wall face of the common ink chamber 31. The ink chamber side plate 40 is formed with a thin wall 41 by forming a concave part 40*a* by half etching a part of an opposite face, and is punched to make an ink introduction port 42 for receiving ink supply from the outside. The thin wall 41 is adapted to absorb pressure toward the opposite side to the nozzle openings 11 occurring when jetting ink drops; it prevents unnecessary positive or negative pressure from being applied to another pressure generation chamber 12 via the common ink chamber 31. In the embodiment, considering the rigidity required at the connection time of the ink introduction port 42 and external ink supply means, etc., the ink chamber side plate 40 is 0.2 mm thick and the thin wall 41 is 0.02 mm thick. However, to skip formation of the thin wall 41 by half etching, the ink chamber side plate 40 may be made 0.02 mm thick from the beginning.

On the other hand, on the elastic film 50 on the opposite side to the opening face of the flow passage formation substrate 10, a lower electrode film 60, for example, about 0.2 μm thick, a piezoelectric film 70, for example, 1 μm thick, and an upper electrode film 80, for example, about 0.1 μm thick are deposited by a process described later, making up a piezoelectric element 300. This piezoelectric element 300 refers to the portion containing the lower electrode film 60, the piezoelectric film 70, and the upper electrode film 80. Generally, one electrode of the piezoelectric element 300 is a common electrode and the other electrodes and the piezoelectric film 70 are patterned for each pressure generation chamber 12. A portion made up of the electrode and the piezoelectric film 70 patterned where piezoelectric distortion occurs as voltage is applied to both electrodes is referred to as piezoelectric active part 320. In the embodiment, the lower electrode film 60 is used as the common electrode of the piezoelectric element 300 and the upper electrode film 80 is used as a discrete electrode of the piezoelectric element 300, but the lower electrode film 60 may be used as a discrete electrode and the upper electrode film 80 may be used as the common electrode for convenience of a drive circuit and wiring. In any case, the piezoelectric active part is formed for each pressure generation chamber 12. Here, the piezoelectric element 300 and a diaphragm displaced by driving the piezoelectric element 300 are collectively called a piezoelectric actuator. In the example, the elastic film 50 and the lower electrode film 60 act as a diaphragm, but the lower electrode film may also serve as the elastic film.

In the invention, a film deposited with the layers making up the piezoelectric element 300 and having a compressive stress is placed on the piezoelectric element 300 side of the flow passage formation substrate 10 for decreasing the initial deflection amount of the diaphragm. In the embodiment, the elastic film 50 is the film having a compressive stress.

Figure 4:
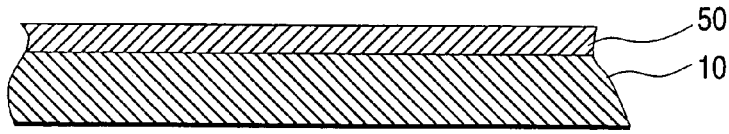
FIGS. 4(*a*)–4(*d*) are sectional views to show a thin film manufacturing process in the first embodiment of the invention.
Figure 4:
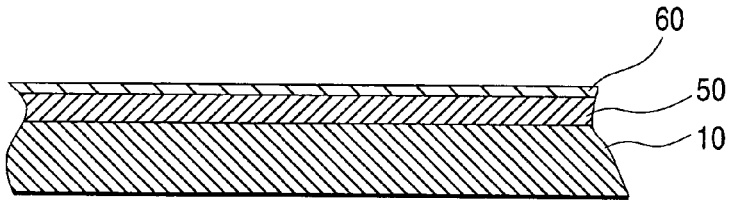
Figure 4:
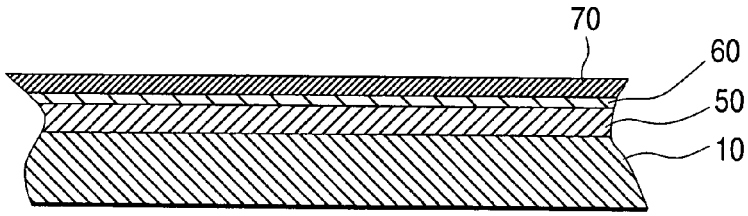
Figure 4:
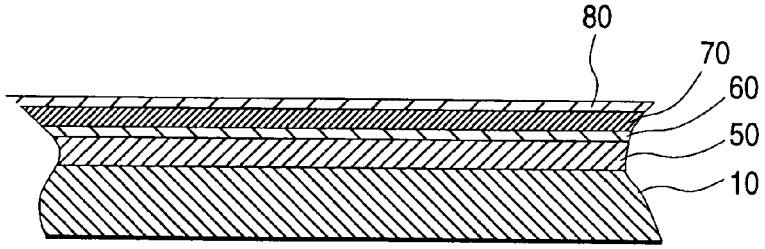

A process of forming the elastic film 50 and the layers making up the piezoelectric element 300 on the flow passage formation substrate 10 made of a silicon monocrystalline substrate will be discussed with reference to FIG. 4.

As shown in FIG. 4*a*, first the elastic film 50 having a compressive stress is formed on one face of a silicon monocrystalline substrate of which the flow passage formation substrate 10 will be made. A material of a film having a predetermined strength and a compressive stress, for example, a polycrystalline substance such as a metal oxide is preferred as a material of the elastic film 50. For example, zirconium oxide, iridium oxide, ruthenium oxide, tantalum oxide, hafnium oxide, osmium oxide, rhenium oxide, rhodium oxide, palladium oxide, compounds thereof, etc., are named. For example, to use the zirconium oxide or hafnium oxide, it is made a monoclinic system whereby a film having a compressive stress can be formed.

In the embodiment, a zirconium layer is formed on the silicon monocrystalline substrate by sputtering, then thermal oxidation processing is performed in oxygen in a diffusion furnace at about 1150° C., thereby forming the elastic film 50 made of zirconium oxide of monoclinic system. Here, when zirconium is oxidized, it is heated to a phase transition temperature or more, thus when it is cooled, it causes transition and becomes a monoclinic system, resulting in zirconium oxide having a compressive stress.

Next, as shown in FIG. 4*b*, the lower electrode film 60 is formed by sputtering Platinum, iridium, etc., is preferred as a material of the lower electrode film 60, because the piezoelectric film 70 (described later) formed by a sputtering method or a sol-gel method needs to be calcined and crystallized at a temperature of about 600° C.–1000° C. in an atmosphere or an oxygen atmosphere after film formation. That is, the material of the lower electrode film 60 must be able to hold conductivity in such a high-temperature, oxygen atmosphere. Particularly if lead zirconate titanate (PZT) is used as the piezoelectric film 70, it is desired that the change in conductivity caused by diffusion of lead oxide is less; platinum, iridium, etc., is preferred for the reasons.

Next, as shown in FIG. 4*c*, the piezoelectric film 70 is formed. The sputtering method can also be used to form the piezoelectric film 70. In the embodiment, however, a so-called sol-gel method is used wherein sol comprising metal organic substance dissolved and dispersed in a solvent is applied and dried to gel and the gel is calcined at a high temperature, thereby providing the piezoelectric film 70 made of metal oxide. A PZT family material is preferred as a material of the piezoelectric film 70 for use with an ink jet recording head.

Next, as shown in FIG. 4*d,* the upper electrode film 80 is formed. The upper electrode film 80 may be made of any material if it has high conductivity; for example, metal of aluminum, gold, nickel, platinum, etc., conductive oxide, etc., can be used. In the embodiment the upper electrode film 80 is formed of platinum by the sputtering method.

Figure 5:
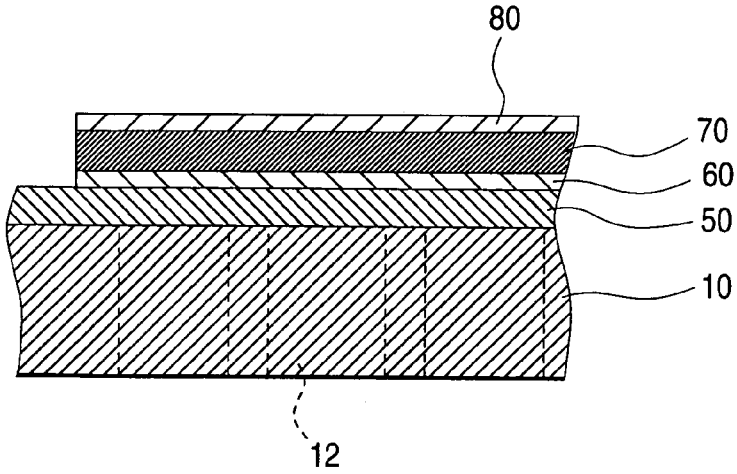
FIGS. 5(*a*)–5(*c*) are sectional views to show a thin film manufacturing process in the first embodiment of the invention.
Figure 5:
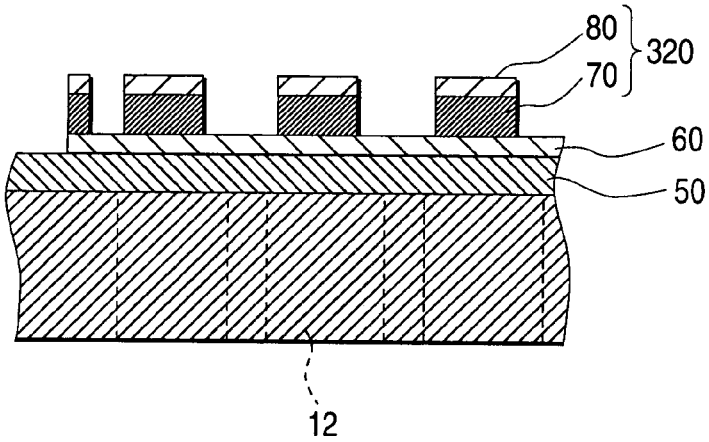
Figure 5:
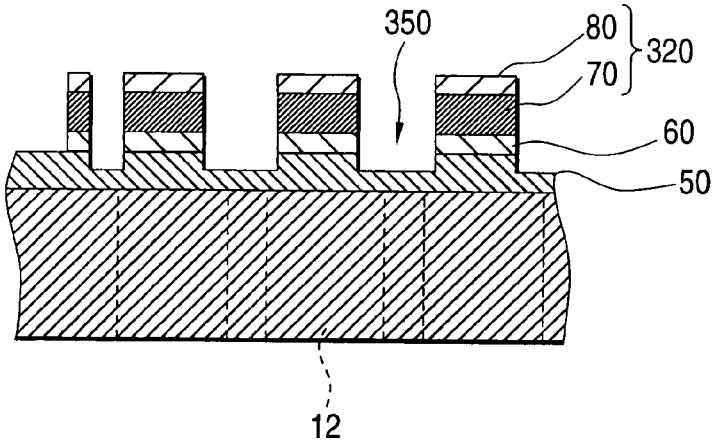

Next, the lower electrode film 60, the piezoelectric film 70, and the upper electrode film 80 are patterned, as shown in FIG. 5.

First, as shown in FIG. 5*a,* the lower electrode film 60, the piezoelectric film 70, and the upper electrode film 80 are etched together and the whole pattern of the lower electrode film 60 is made. Next, as shown in FIG. 5*b,* the piezoelectric film 70 and the upper electrode film 80 are etched for patterning the piezoelectric active parts 320. Next, as shown in FIG. 5*c*, the lower electrode film 60 of the arm part of the diaphragm on both sides of the piezoelectric active parts 320 in the width direction thereof facing the pressure generation chambers 12 is etched and removed and further the elastic film 50 is overetched to a part in the thickness direction for forming elastic film removal parts 350. The depth of the overetching of the elastic film 50 may be determined considering the stress balance of the whole film; particularly, if the lower electrode film 60 has a tensile stress, preferably the overetching is deeper than at least the thickness of the lower electrode film 60. For example, in the embodiment, the elastic film 50 is formed at a depth of about 0.4 μm.

Figure 6:
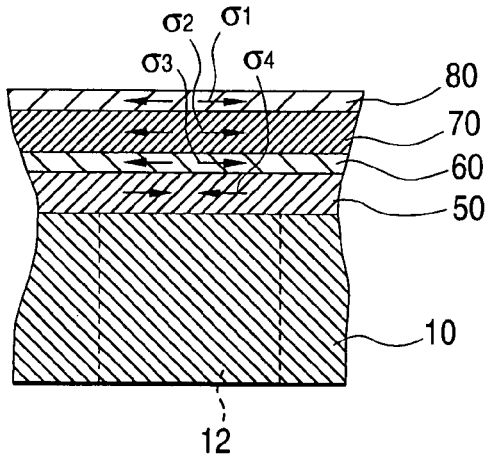
FIGS. 6(*a*)–6(*c*) are sectional views to show the state of stresses that a piezoelectric active part in the first embodiment of the invention receives at pressure generation chamber formation time.
Figure 6:
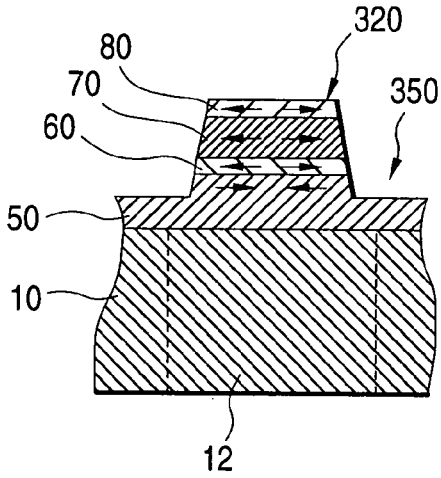
Figure 6:
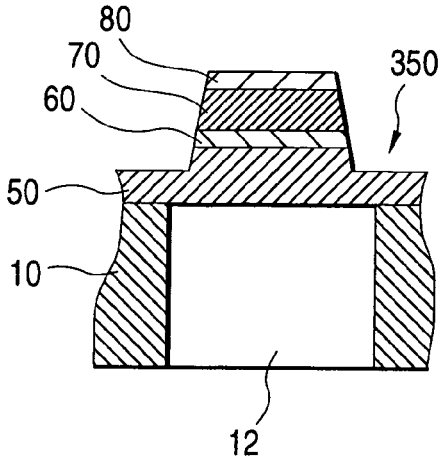

In the embodiment, then, the pressure generation chambers 12 are formed by etching. The state of stresses that each piezoelectric active part 320 receives at the time will be discussed. FIG. 6 is an illustration to schematically show the state of a stress that each layer receives before and after the pressure generation chambers 12 are formed by etching.

As shown in FIG. 6*a,* the lower electrode film 60, the piezoelectric film 70, and the upper electrode film 80 receive tensile stresses from the flow passage formation substrate 10 and the elastic film 50 receives a compressive stress. Thus, as shown in FIG. 6*b,* if the piezoelectric active parts 320 are patterned, parts of tensile stresses $\sigma_3$, $\sigma_2$, and $\sigma_1$ of the lower electrode film 60, the piezoelectric film 70, and the upper electrode film 80 are released and as a part of the elastic film 50 is removed, a part of compressive stress $\sigma_4$ is also released. The magnitude of the released compressive stress $\sigma_4$ of the elastic film 50 is proportional to the depth of removal of the elastic film 50. Thus, in the embodiment, the elastic film 50 is removed deeper than at least the thickness of the lower electrode film 60 for adjusting the stress balance of the whole film, as described above. Therefore, then, as shown in FIG. 6*c,* if the pressure generation chamber 12 is formed below the piezoelectric active part 320, the compressive stress $\sigma_4$ of the elastic film 50 is opposite in direction to the tensile stresses $\sigma_3$, $\sigma_2$, and $\sigma_1$ of the lower electrode film 60, the piezoelectric film 70, and the upper electrode film 80 received from the flow passage formation substrate 10. Thus, if the force of releasing the tensile stresses $\sigma_3$, $\sigma_2$, and $\sigma_1$ of the lower electrode film 60, the piezoelectric film 70, and the upper electrode film 80 balances with the force of releasing the compressive stress $\sigma_4$ of the elastic film 50, diaphragm deflection little occurs.

Figure 7:
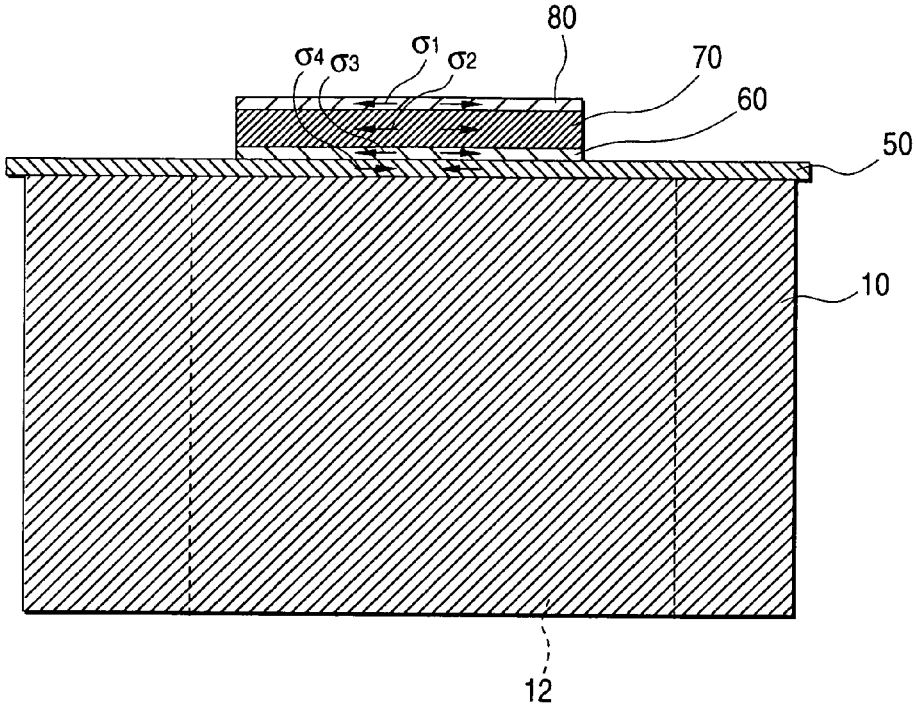
FIGS. 7(*a*)–7(*b*) are sectional views to show the state of stresses that a conventional piezoelectric active part receives at pressure generation chamber formation time.
Figure 7:
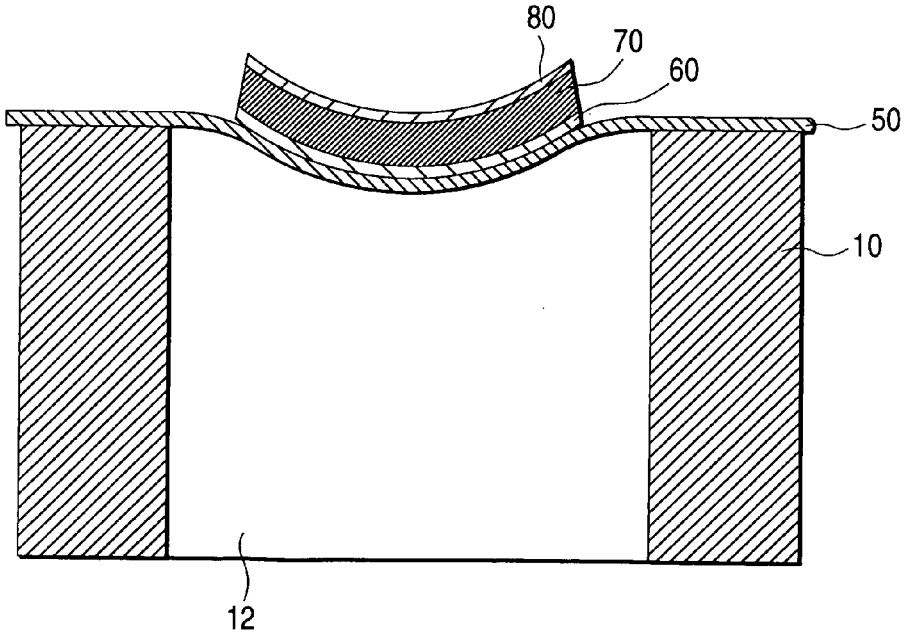

If elastic film removal parts 350 are not formed although the elastic film 50 receives a compressive stress, the tensile stresses $\sigma_3$, $\sigma_2$, and $\sigma_1$ remain in the lower electrode film 60, the piezoelectric film 70, and the upper electrode film 80 before the pressure generation chambers 12 are formed, as shown in FIG. 7*a*. Thus, if the pressure generation chambers 12 are formed, the tensile stresses $\sigma_3$, $\sigma_2$, and $\sigma_1$ are released and become contracting forces, resulting in deformation of the elastic film 50 as a downward convex form, which remains as initial deformation, as shown in FIG. 7*b*. When the elastic film 50 receives a tensile stress rather than a compressive stress, if elastic film removal parts 350 are formed, the tensile stress of the elastic film 50 is also removed in a part and becomes a contracting force, causing the diaphragm to become deformed more downward convex.

Thus, in the embodiment, the elastic film 50 is formed of the material having a compressive force and a part of the elastic film 50 is overetched to form the elastic film removal parts 350. Then, after the piezoelectric active parts 320 are patterned and the pressure generation chambers 12 are formed, compressive force is released in the elastic film removal parts 350 on both sides of each piezoelectric active part 320 in the width direction thereof and the elastic film 50 receives a tensile stress. Therefore, the stresses in the compression direction of the lower electrode film 60, the piezoelectric film 70, and the upper electrode film 80 are offset and the initial deflection amount of the diaphragm caused by forming the pressure generation chambers 12 can be decreased or eliminated. At the same time, deformation of the piezoelectric film 70 can be prevented, thus the piezoelectric characteristic of the piezoelectric film 70 before the pressure generation chambers 12 are formed can be maintained. Therefore, the head displacement efficiency can be improved. Further, in the embodiment, the elastic film 50 is formed of metal oxide of a polycrystalline substance for providing a predetermined strength, so that degradation of durability is also prevented.

Hitherto, a zirconium oxide film has been used as an elastic film. In the invention, however, the zirconium oxide film is made the monoclinic system film having a strong compressive stress and the compressive stress is released by etching, thereby easing initial deformation. A technique for preventing films from peeling off by making a zirconium oxide film a monoclinic system film for balancing stresses received on complex film is also proposed, but it does not release the compressive stress of the zirconium oxide film for easing initial deflection.

In the description, the pressure generation chambers 12 are formed after the piezoelectric active parts 320 are patterned; in fact, as shown in FIG. 2, an insulator layer 90 having electric insulation may be formed so as to cover at least the margins of the upper face of the upper electrode film 80 and the sides of the piezoelectric film 70 and the lower electrode film 60. Further, a part of the portion covering the upper face of the portion corresponding to one end of each piezoelectric active part 320 of the insulator layer 90 may be formed with a contact hole 90*a* for exposing a part of the upper electrode film 80 to connect to a lead electrode 100, and the lead electrode 100 may be connected at one end to the upper electrode film 80 through the contact hole 90*a* and extend at the other end to a connection terminal part. Preferably, the lead electrode 100 is formed to a narrow width as much as possible to the extent that it can reliably supply a drive signal to the upper electrode film 80. In the embodiment, the contact hole 90*a* is made in the area opposed to the pressure generation chamber 12, but the piezoelectric film 70 and the upper electrode film 80 of the piezoelectric active part 320 may be extended from one end in the length direction of the pressure generation chamber 12 to the area opposed to the surrounding wall, and the contact hole 90*a* may be made in a position opposed to the surrounding wall of the pressure generation chamber 12.

In the film formation and anisotropic etching sequence described, a large number of chips are formed on one wafer at the same time and after the process terminates, they are separated for each flow passage formation substrate 10 of one chip size as shown in FIG. 1. Each flow passage formation substrate 10 is bonded to the seal plate 20, the common ink chamber formation substrate 30, and the ink chamber side plate 40 in order for one piece to form an ink jet recording head.

With the ink jet recording head, ink is taken in from the ink introduction port 42 connected to external ink supply means (not shown) and the inside of the recording head from the common ink chamber 31 to the nozzle openings 11 is filled with ink, and a voltage is applied between the lower electrode film 60 and the upper electrode film 80 via the lead electrode 100 according to a record signal from an external drive circuit (not shown) for deflection-deforming the elastic film 50, the lower electrode film 60, and the piezoelectric film 70, thereby raising pressure in the pressure generation chambers 12 and jetting ink drops through the nozzle openings 11.

Figure 8:
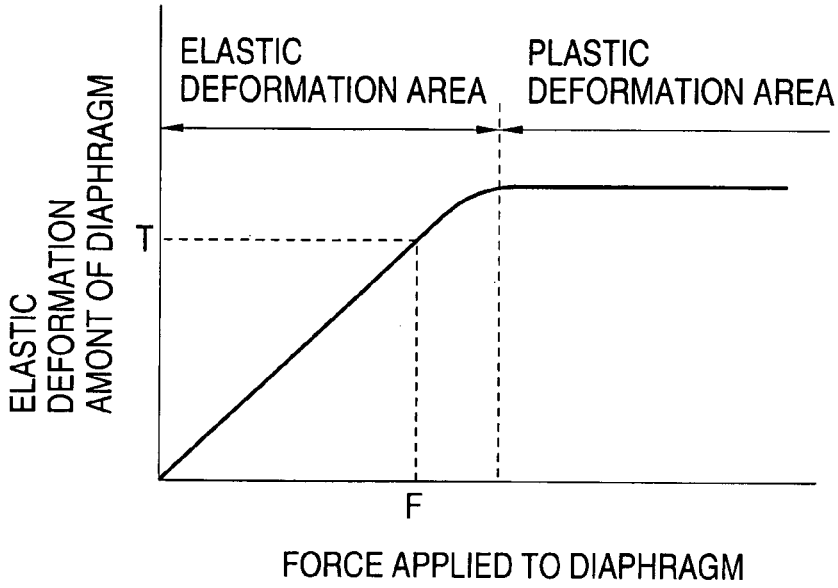
FIGS. 8(*a*)–8(*b*) are graphs each to show the relationship between the force applied to a diaphragm and the elastic deformation amount when a piezoelectric actuator is driven.
Figure 8:
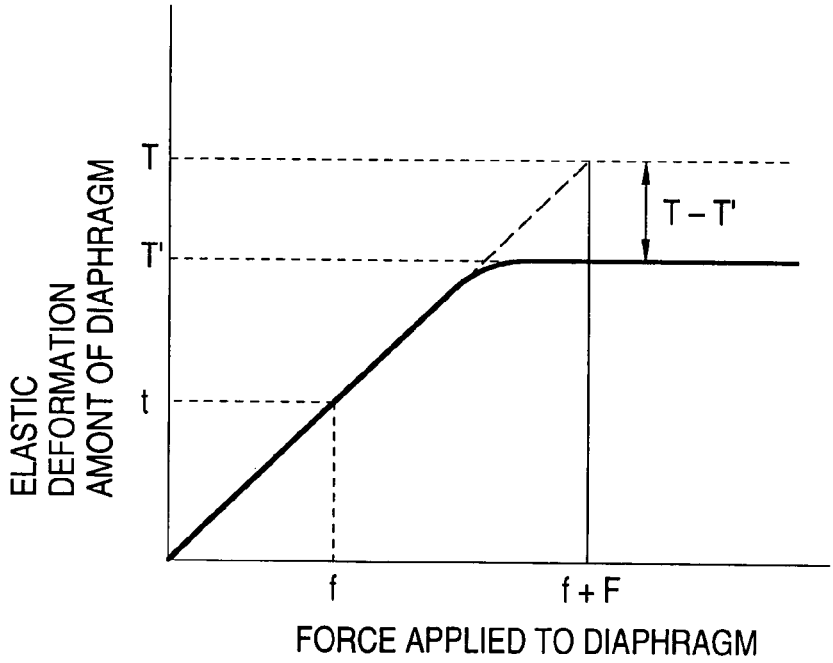

FIG. 8*a* shows the relationship between the force applied to the diaphragm and the elastic deformation amount when the piezoelectric element of the embodiment is driven. As shown here, in the embodiment, the diaphragm does not become deformed at the initial stage, so that deformation T relative to force F occurring at the driving time occurs in the elastic deformation area. On the other hand, as shown in FIG. 8*b*, if initial deformation t is caused by initially applied force f by the stresses of the lower electrode film 60, the piezoelectric film 70, and the upper electrode film 80, when force F is applied at the driving time, the plastic deformation area is entered, thus corresponding deformation T is not obtained and deformation T' occurs; (T–T') becomes a deformation loss.

Figure 9:
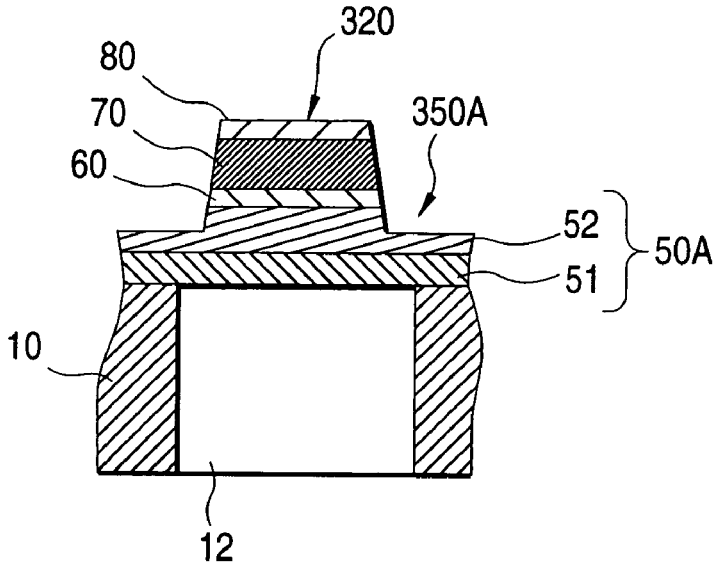
FIG. 9 is a sectional view of the main part of an ink jet recording head according to a second embodiment of the invention.

FIG. 9 is a sectional view of the main part of an ink jet recording head according to a second embodiment of the invention.

The second embodiment has a similar structure to that of the first embodiment except that an elastic film is made up of multiple layers.

In the second embodiment, as shown in FIG. 9, an elastic film 50A is made up of two layers of a first elastic film 51 made of a silicon oxide film 1.0 μm thick, for example, formed on a flow passage formation substrate 10 and a second elastic film 52 formed of a metal oxide film, etc., having a compressive stress, such as zirconium oxide, for example, on the first elastic film 51. In the embodiment, a part of the second elastic film 52 is overetched to form an elastic film removal part 350A, thereby decreasing the initial deflection amount of a diaphragm and improving the piezoelectric characteristic. Of course, all of the second elastic film 52 in the thickness direction thereof may be removed to form the elastic film removal part 350A.

According to the configuration of the embodiment, a similar advantage to that of the first embodiment is also provided. Further, the strength of the elastic film can be enhanced by making the elastic film of two layers and the diaphragm displacement efficiency can be reliably improved by forming the elastic film removal part 350A Preferably, the elastic film deposited below the elastic film formed with the elastic film removal part 350A (in the embodiment, the second elastic film 52), namely, the first elastic film 51 in the embodiment has a compressive stress, but the invention is not limited to it. At least the second elastic film 52 may have a compressive stress and the first elastic film 51 may have a tensile stress. In the embodiment, the first elastic film 51 is formed of a silicon oxide film, but the invention is not limited to it; for example, it may be formed of a boron-doped silicon film, a metal oxide film, or the like.

To form the elastic film of multiple layers as in the embodiment, the elastic film having a compressive stress formed with the elastic film removal part may be formed of a silicon oxide film.

Figure 10:
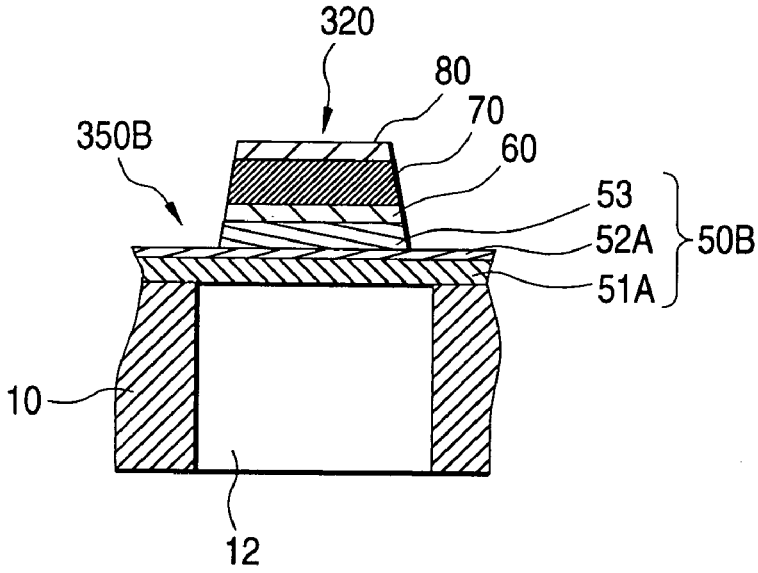
FIG. 10 is a sectional view of the main part of an ink jet recording head according to a third embodiment of the invention.

FIG. 10 is a sectional view of the main part of an ink jet recording head according to a third embodiment of the invention.

The third embodiment has a similar structure to that of the above-described embodiment except that an elastic film is made up of multiple layers.

In the third embodiment, as shown in FIG. 10, an elastic film 50B is made up of three layers of a first elastic film 51A made of silicon oxide 1 μm thick, for example, formed on a flow passage formation substrate 10, a second elastic film 52A made of metal of platinum, etc., 0.2 μm thick, for example, formed on the first elastic film 51, and a third elastic film 53 made of metal oxide, etc., of zirconium oxide, etc., having a compressive stress 1 μm thick, for example. In the embodiment, a part of the third elastic film 53 of the top layer in the plane direction thereof is removed to the second elastic film 52A to form an elastic film removal part 350B.

In the embodiment, the second elastic film 52A is formed of platinum, but the invention is not limited to it; the second elastic film 52A may be formed of metal having flexibility, such as iridium.

Thus, the second elastic film 52A is formed of a metal material of platinum, iridium, etc., different from the third elastic film 53 in etching characteristic and not etched selectively, whereby the elastic film removal part 350B can be formed easily. The second elastic film 52A may be a metal oxide having a tensile stress, such as stabilization or partial stabilization zirconium oxide.

In the embodiment, the first elastic film 51 is formed of a silicon oxide film, but may be formed of a boron-doped silicon film, etc.

According to the configuration of the embodiment, a similar advantage to that of the above-described embodiment can also be provided. In the third embodiment, below the third elastic film 53 etched, the first and second elastic films 51A and 52B formed of different materials are placed, so that diaphragm deflection caused by formation of the elastic film removal part 350B and pressure generation chambers 12 can be more suppressed.

Figure 11:
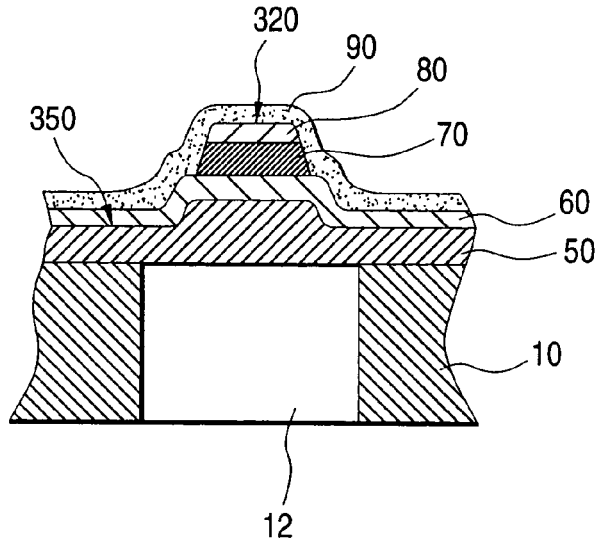
FIG. 11 is a sectional view of the main part of an ink jet recording head according to a fourth embodiment of the invention.

FIG. 11 is a sectional view of the main part of an ink jet recording head according to a fourth embodiment of the invention.

As shown in the figure, the fourth embodiment is similar to the first embodiment except that a lower electrode film 60 is formed uniformly on an elastic film 50 without patterning for each piezoelectric active part 320.

A formation method of the piezoelectric active part 320 in the fourth embodiment is not limited; after an elastic film removal part 350 is formed in a part of the elastic film 50, lower electrode film 60, piezoelectric film 70, and upper electrode film 80 may be formed and patterned.

Also in the configuration, a similar advantage to that of the above-described embodiment can be provided. Since the lower electrode film 60 is formed uniformly in the fourth embodiment, the stress acting on the elastic film 50 in the portion corresponding to both sides of the piezoelectric active part 320 in the width direction thereof can be suppressed, so that destruction of the elastic film 50 by driving the piezoelectric active part 320 can be prevented.

Since overetching of the lower electrode film 60 is not required, the film thickness of so-called arm part on both sides of the piezoelectric active part 320 in the width direction thereof is adjusted only by the depth of the elastic film removal part 350 and the film thickness of the arm part can be formed precisely. Further, damage to the piezoelectric film 70 caused by overetching the lower electrode film 60 does not occur and the jet characteristic can be improved.

Figure 12:
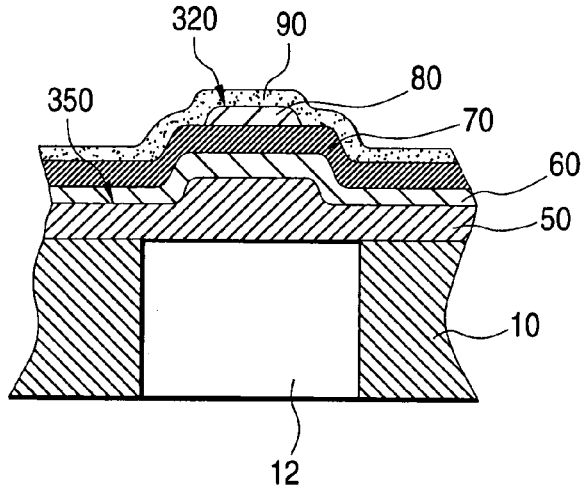
FIGS. 12(*a*)–12(*b*) are sectional views of the main part to show a modified example of the ink jet recording head according to the fourth embodiment of the invention.
Figure 12:
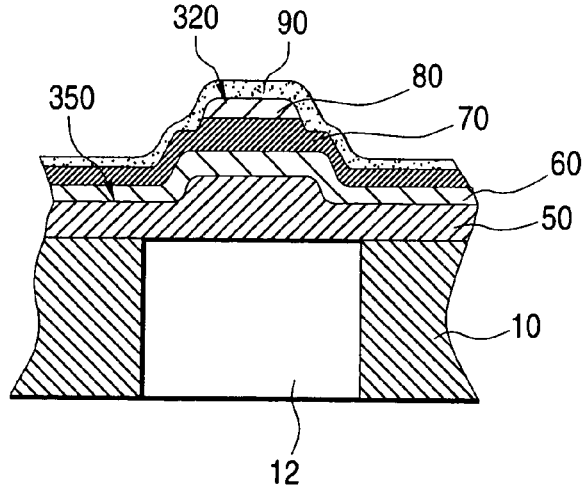

In the embodiment, the piezoelectric film 70 is placed separately corresponding to each pressure generation chamber 12 to form the piezoelectric active part 320, but the invention is not limited to it. For example, as shown in FIG. 12*a,* the piezoelectric film 70 may be placed on the whole flow passage formation substrate and the upper electrode film 80 may be placed separately corresponding to each pressure generation chamber 12. In this case, up to a part of the piezoelectric film 70 in the thickness direction thereof may be removed by patterning the upper electrode film 80. Further, for example, as shown in FIG. 12*b,* patterning may be executed aggressively to a part of the piezoelectric film in the thickness direction thereof other than the area corresponding to the pressure generation chamber 12.

Figure 13:
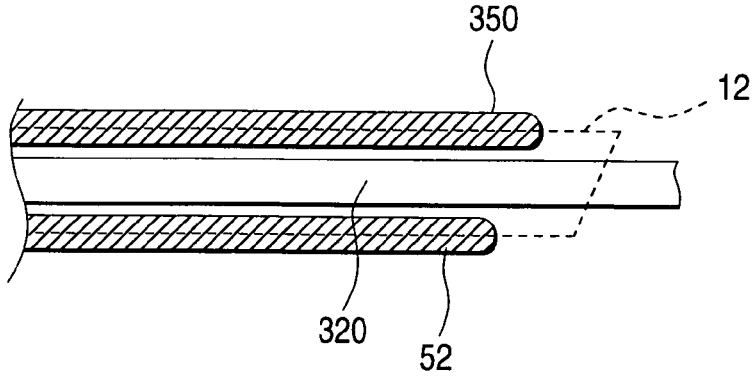
FIGS. 13(*a*)–13(*c*) are sectional views of the main part to show a modified example of the ink jet recording head according to the fourth embodiment of the invention.
Figure 13:
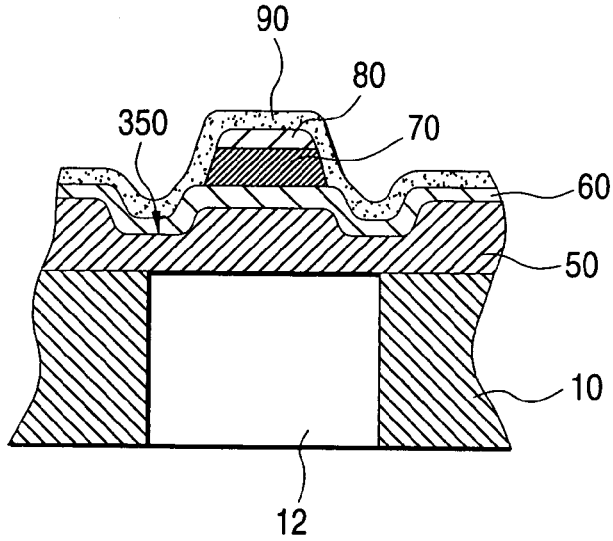
Figure 13:
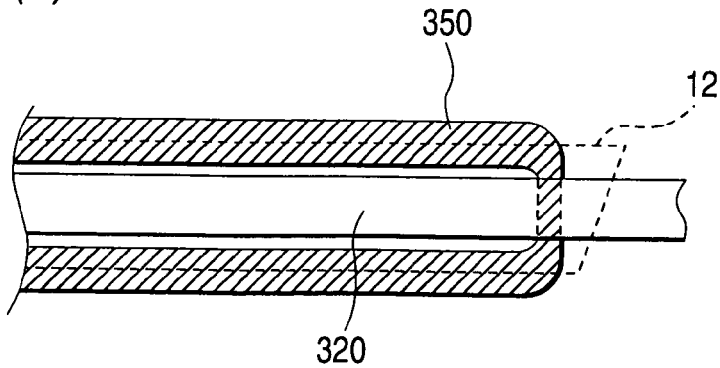

In the above-described embodiment, the elastic film 50 in all areas other than the formation area of the piezoelectric active part 320 is patterned to form the elastic film removal part 350, but the invention is not limited to it. For example, as shown in FIGS. 13*a* and 13*b,* it may be formed only in the portion along the margin of the pressure generation chamber 12 on both sides of the piezoelectric active part 320 in the width direction thereof or, for example, as shown in FIG. 13*c,* it may be formed in the portion corresponding to both sides of the piezoelectric active part 320 in the width direction thereof and the outside of the end of the piezoelectric active part 320 in the length direction thereof. In this case, unlike the case where the lower electrode film 60 is removed, if the elastic film 50 is formed with the elastic film removal part 350, the piezoelectric film 70 can be extended onto the surrounding wall of the pressure generation chamber 12. In any way, the initial deflection amount of the elastic film 50 can be decreased and diaphragm displacement can be improved as in the above-described embodiment.

Figure 14:
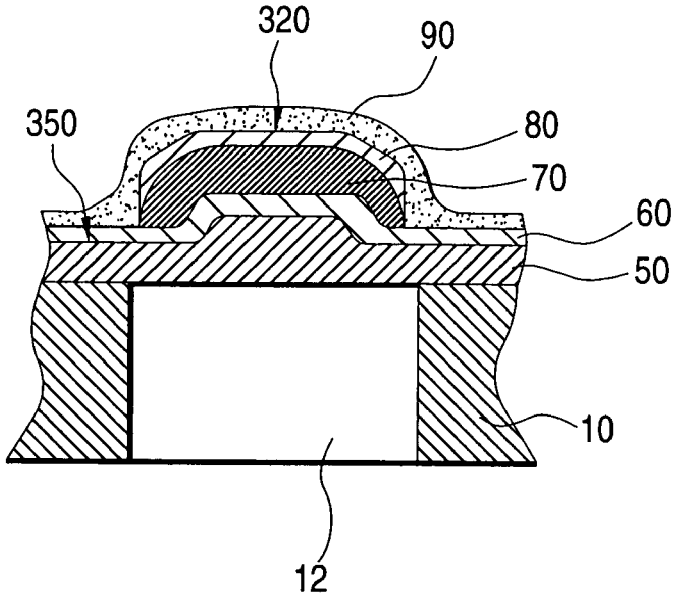
FIG. 14 is a sectional view of the main part of an ink jet recording head according to a fifth embodiment of the invention.

FIG. 14 shows the forms of a piezoelectric active part and a pressure generation chamber of an ink jet recording head according to a fifth embodiment of the invention.

The fifth embodiment is the same as the first embodiment except that both ends of a piezoelectric active part 320 in the width direction thereof are extended each to the area opposed to an elastic film removal part 350 and a piezoelectric film 70 forming the piezoelectric active part 320 is formed in a uniform thickness.

According to the configuration, a similar advantage to that of the fourth embodiment is provided. In the fifth embodiment, the piezoelectric active part is formed so that both ends in the width direction are positioned in the area opposed to the elastic film removal part 350. That is, the piezoelectric active part 320 is placed so as to sandwich both sides of an elastic film 50 in the width direction thereof in the relatively projected portion by the elastic film removal part 350. Therefore, a position shift in the width direction of the piezoelectric active part 320 can be prevented.

Figure 15:
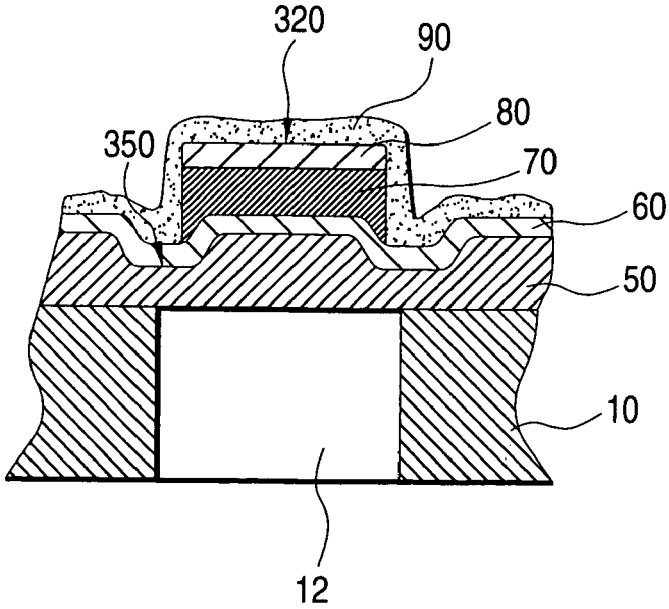
FIG. 15 is a sectional view of the main part of an ink jet recording head according to a sixth embodiment of the invention.

FIG. 15 shows the forms of a piezoelectric active part and a pressure generation chamber of an ink jet recording head according to a sixth embodiment of the invention.

The sixth embodiment has a basic structure similar to that of the above-described embodiment except that an elastic film removal part 350 is formed only in an elastic film 50 in the area corresponding to both sides of a piezoelectric active part 320 in the width direction thereof and the piezoelectric active part 320 is extended to the area opposed to the elastic film removal part 350.

The elastic film removal part 350 is thus placed in a narrow width, whereby at the film formation time, a surface of a piezoelectric film 70 in the area opposed to the elastic film removal part 350 is not formed along the form of the elastic film 50 and is formed roughly like a plane. Thus, if the piezoelectric active parts 320 are patterned, the piezoelectric film 70 in the area opposed to the elastic film removal part 350 remains thicker than other portions.

Thus, the embodiment also provides a similar advantage to that of the second embodiment. In addition, an electric breakdown of the piezoelectric film 70 at the end of the piezoelectric active part 320 in the width direction thereof is prevented and reliability can be improved.

A seventh embodiment of the invention is the same as the first embodiment except that a lower electrode film 60 is a film having a compressive stress in place of an elastic film 50 and at least a part of the lower electrode film 60 is removed to form a lower electrode film removal part 360 rather than elastic film removal part 350 on both sides of a piezoelectric active part 320 in the width direction thereof and except that the elastic film 50 is a silicon dioxide film provided by oxidizing a surface of a flow passage formation substrate 10 made of a silicon monocrystalline substrate.

Figure 16:
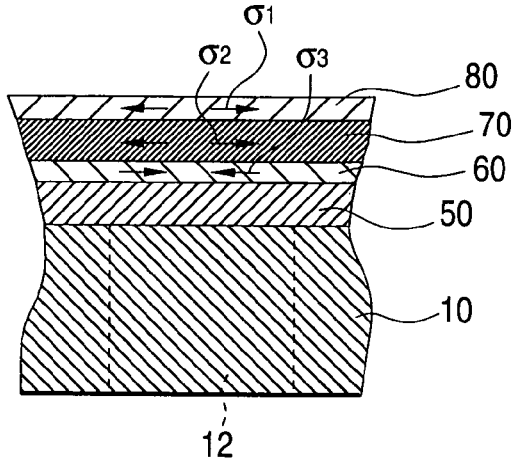
FIGS. 16(*a*)–16(*c*) are sectional views to show the state of stresses that a piezoelectric active part in a seventh embodiment of the invention receives at pressure generation chamber formation time.
Figure 16:
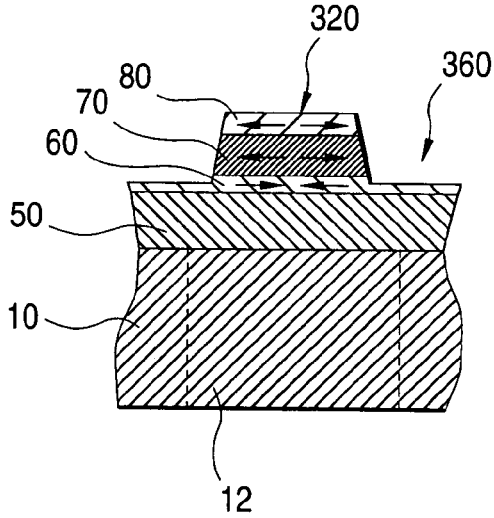
Figure 16:
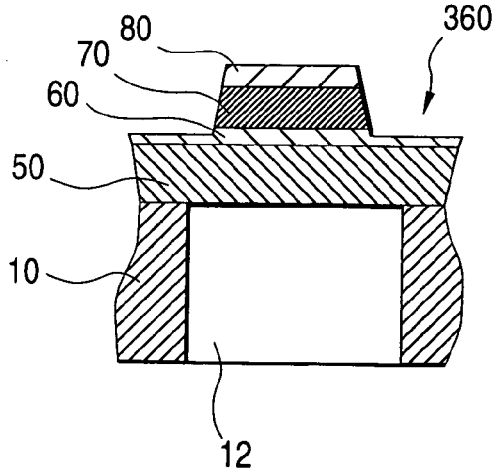

The state of stresses that the piezoelectric active part 320 in the embodiment receives will be discussed. FIG. 16 is an illustration to schematically show the state of a stress that each layer receives before and after pressure generation chambers 12 are formed by etching.

As shown in FIG. 16*a,* a piezoelectric film 70 and an upper electrode film 80 receive tensile stresses $\sigma_2$, and $\sigma_1$ from the flow passage formation substrate 10 and in the embodiment, the lower electrode film 60 receives compressive stress $\sigma_3$. Thus, as shown in FIG. 16*b,* if the piezoelectric active parts 320 are patterned, parts of the tensile stresses $\sigma_2$, and $\sigma_1$ of the piezoelectric film 70 and the upper electrode film 80 are released and a part of the compressive stress $\sigma_3$ of the lower electrode film 60 is released. Next, as shown in FIG. 16*c*, if the pressure generation chamber 12 is formed below the piezoelectric active part 320, the tensile stresses $\sigma_2$, and $\sigma_1$ of the piezoelectric film 70 and the upper electrode film 80 received from the flow passage formation substrate 10 are released and become force in the compression direction. On the other hand, the compressive stress $\sigma_3$ of the lower electrode film 60 where the lower electrode film removal part 360 is formed is released and becomes a force in the tension direction. Therefore, if the force of releasing the stresses σor and σ, of the piezoelectric film 70 and the upper electrode film 80 balances with the force of releasing the compressive stress or of the lower electrode film 60, diaphragm will be deflected by only a small amount.

Preferably, the material of the lower electrode film 60 having such a compressive stress is a material of a film having a compressive stress, for example, metal, conductive oxide, or conductive nitride. Specifically, for example, platinum, iridium, ruthenium, osmium, rhenium, rhodium, palladium, compounds thereof, etc., are named as metal. For example, ruthenium oxide, indium oxide tin, cadmium indium oxide, tin oxide, manganese oxide, rhenium oxide, iridium oxide, strontium ruthenium oxide, indium oxide, zinc oxide, titanium oxide, zirconium oxide, hafnium oxide, molybdenum oxide, compounds thereof, etc., are named as conductive oxides. Niobium nitride, zirconium nitride, tungsten nitride, hafnium nitride, molybdenum nitride, tantalum nitride, chromium nitride, palladium nitride, compounds thereof, etc., are named as conductive nitrides.

The lower electrode film 60 can be formed by the sol-gel method, the sputtering method, etc., as in the above-described embodiment. Further, as described above, generally the piezoelectric film 70, which is formed by the sputtering method or the sol-gel method, needs to be calcined and crystallized at a temperature of about 600° C.–1000° C. in an atmosphere or an oxygen atmosphere after film formation. Thus, if metal of platinum, iridium, etc., is used as the material of the lower electrode film 60, the lower electrode film 60 develops a tensile stress in such a high-temperature, oxygen atmosphere. In such a case, the lower electrode film 60 can be made to have a compressive stress by a method of forming a precursor film of PZT by the sol-gel method, the sputtering method, or the like, then crystal-growing the piezoelectric film 70 at low temperature by a high-pressure treatment method in an alkaline water solution.

Thus, in the embodiment, the lower electrode film 60 is formed of the material having a compressive force and a part of the lower electrode film 60 is overetched to form the lower electrode film removal parts 360. Then, after the piezoelectric active parts 320 are patterned and the pressure generation chambers 12 are formed, compressive force is released in the lower electrode film removal parts 360 placed on both sides in the width direction of each piezoelectric active part 320, whereby the elastic film 50 receives a stress in the tension direction. Therefore, the stresses of the piezoelectric film 70 and the upper electrode film 80 in the compression direction are offset and the initial deflection amount of a diaphragm caused by forming the pressure generation chambers 12 can be decreased or eliminated. At the same time, deformation of the piezoelectric film 70 can be prevented, thus the piezoelectric characteristic of the piezoelectric film 70 before the pressure generation chambers 12 are formed can be maintained. That is, the head displacement efficiency can be improved.

The magnitude of the released compressive stress of the lower electrode film 60 is determined by the depth of the lower electrode film removal part 360. Therefore, preferably the depth of the lower electrode film removal part 360 is determined considering the stress balance of the whole film; for example, in the embodiment, the depth is set to 0.1 μm.

Figure 17:
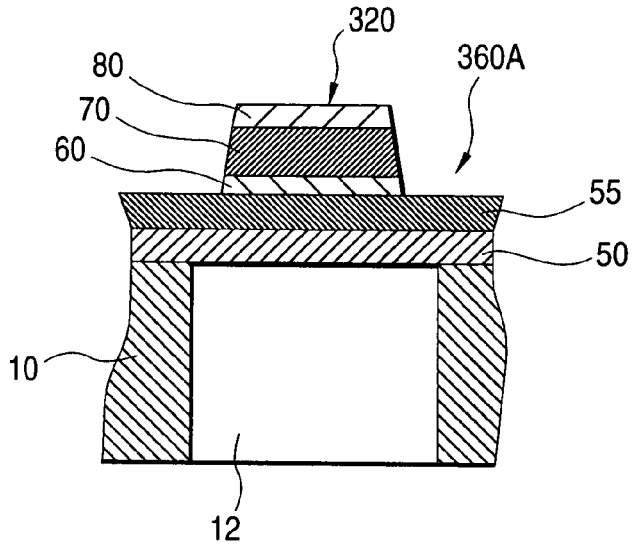
FIG. 17 is a sectional view of the main part of an ink jet recording head according to an eighth embodiment of the invention.

FIG. 17 is a sectional view of the main part of an ink jet recording head according to an eighth embodiment of the invention.

In the eighth embodiment, as shown in FIG. 17, a lower electrode film 60 is removed completely in the thickness direction thereof to form a lower electrode removal part 360A Since the lower electrode film 60 in the portion corresponding to the lower electrode removal part 360A is removed completely, a diaphragm in the portion becomes thin and it is feared that the strength may be lowered. Thus, a second elastic film 55 made of zirconium oxide, etc., for example, is placed between an elastic film 50 and the lower electrode film 60 for holding the strength of the elastic film 50. The eighth embodiment is the same as the seventh embodiment in other points.

According to the configuration, a similar advantage to that of the seventh embodiment is provided. In the eighth embodiment, the second elastic film 55 is placed, so that the strength of the elastic film 50 is held and degradation of durability is prevented.

In the embodiment, the second elastic film 55 is placed on the elastic film 50, but the invention is not limited to it. For example, the second elastic film made of zirconium oxide, etc., may be placed directly on a flow passage formation substrate 10 without placing the elastic film.

A ninth embodiment of the invention is the same as the first embodiment except that an upper electrode film 80 is a film having a compressive stress in place of a lower electrode film 60 and only the upper electrode film 80 and a piezoelectric film 70 are removed on both sides of a piezoelectric active part 320 in the width direction thereof.

Figure 18:
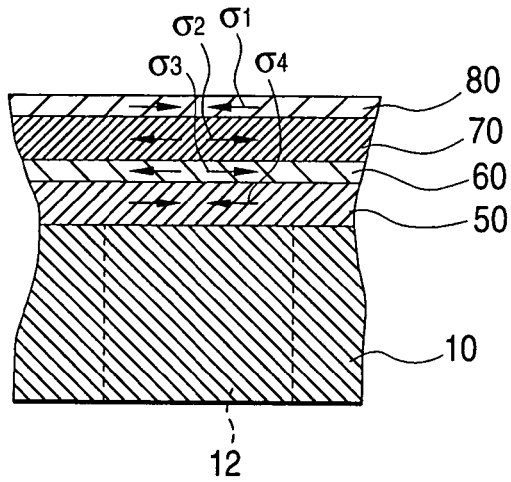
FIGS. 18(*a*)–18(*c*) are sectional views to show the state of stresses that a piezoelectric active part in a ninth embodiment of the invention receives at pressure generation chamber formation time.
Figure 18:
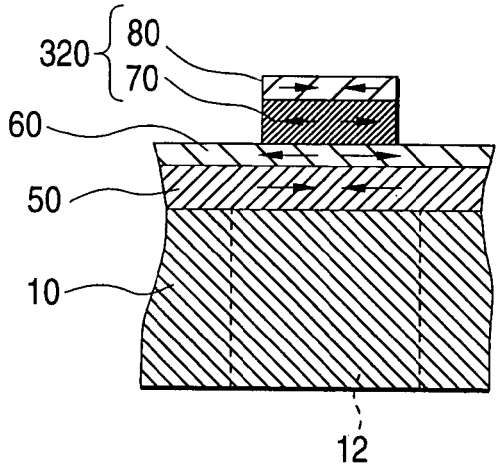
Figure 18:
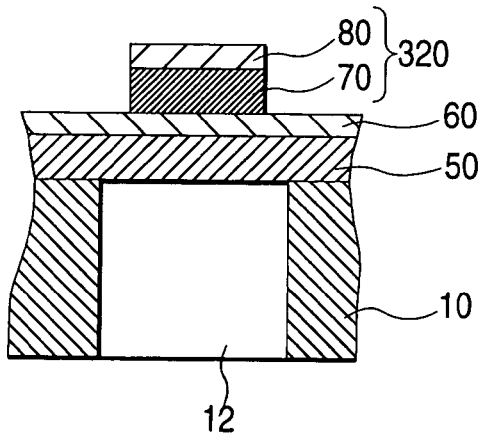

The state of stresses that the piezoelectric active part 320 in the embodiment receives will be discussed. FIGS. 18(*a*)–18(*c*) are illustrations to schematically show the state of a stress that each layer receives before and after pressure generation chambers 12 are formed by etching.

As shown in FIG. 18*a,* in a state in which the layers of the piezoelectric film 70 and the upper electrode film 80 are formed, the piezoelectric film 70 and a lower electrode film 60 receive tensile stresses $\sigma_2$, and $\sigma_3$ from a flow passage formation substrate 10 and the upper electrode film 80 and an elastic film 50 receive compressive stresses $\sigma_1$ and $\sigma_4$. As shown in FIG. 18*b,* if the piezoelectric active parts 320 are patterned, parts of the stresses $\sigma_1$ and $\sigma_2$ of the upper electrode film 80 and the piezoelectric film 70 are released. Next, as shown in FIG. 18*c,* if the pressure generation chamber 12 is formed below the piezoelectric active part 320, the stresses that the piezoelectric film 70 and the upper electrode film 80 receive from the flow passage formation substrate 10 are opposite in direction to each other. Thus, if the force of releasing the tensile stress $\sigma_2$ of the piezoelectric film 70 balances with the force of releasing the compressive stress $\sigma_1$ of the upper electrode film 80, deflection of a diaphragm made up of the lower electrode film 60 and the elastic film 50 little occurs.

Preferably, the material of the upper electrode film 80 having such a compressive stress is a material having a compressive stress and high conductivity, for example, any metal of platinum, palladium, iridium, rhodium, osmium, ruthenium, or rhenium.

The upper electrode film 80 may be formed by the sputtering method as in the above-described embodiment. In the ninth embodiment, the upper electrode film 80 is formed by the sputtering method in a predetermined gas, for example, at gas pressure 1 Pa or less, whereby the gas is taken into the upper electrode film 80, so that a larger compressive stress can be given to the upper electrode film 80.

Preferably, the gas taken into the upper electrode film 80 is an inert gas, for example, helium, neon, argon, krypton, xenon, or radon. The conditions of the gas pressure, etc., in sputtering may be adjusted appropriately according to the sputtering system, material, etc.

In the embodiment, a compressive stress is thus given to the upper electrode film 80 at least in the film formation state, so that the upper electrode film 80 receives a stress in the tension direction (the compressive stress is released) after the piezoelectric active parts 320 are patterned and the pressure generation chambers 12 are formed. The tension stress and the stress of the piezoelectric film 70 in the compression direction are offset and the initial deflection amount of the diaphragm caused by forming the pressure generation chambers 12 can be decreased or eliminated. As described above, since the initial deflection amount of the diaphragm is decreased, a plastic deformation area is not entered even by driving the piezoelectric active part 320 and the deformation amount can be improved substantially.

In the embodiment, an inert gas is taken into the upper electrode film 80, whereby a larger compressive stress is given to the upper electrode film 80, but the invention is not limited to it. Basically, the upper electrode film 80 has a compressive force, thus an inert gas need not necessarily be taken into the upper electrode film 80, needless to say.

A tenth embodiment of the embodiment is the same as the ninth embodiment except that an upper electrode film 80 is given a compressive stress by adding an additive of semimetal, semiconductor, insulator, or the like of constituents different from the metal of the upper electrode film 80.

Figure 19:
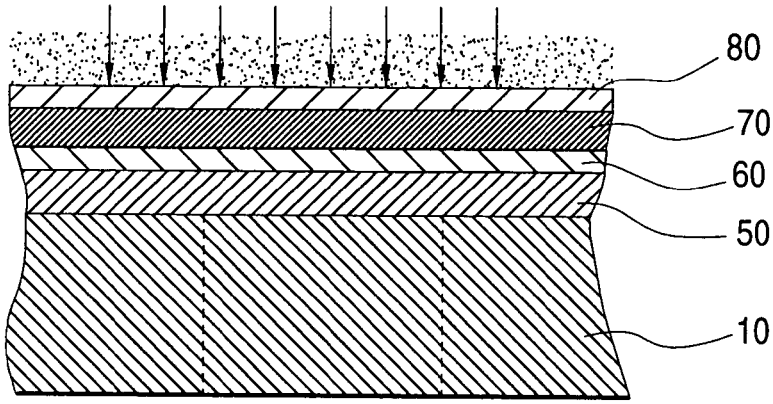
FIGS. 19(*a*)–19(*b*) are sectional views to show a manufacturing method of an upper electrode film according to a tenth embodiment of the invention.
Figure 19:
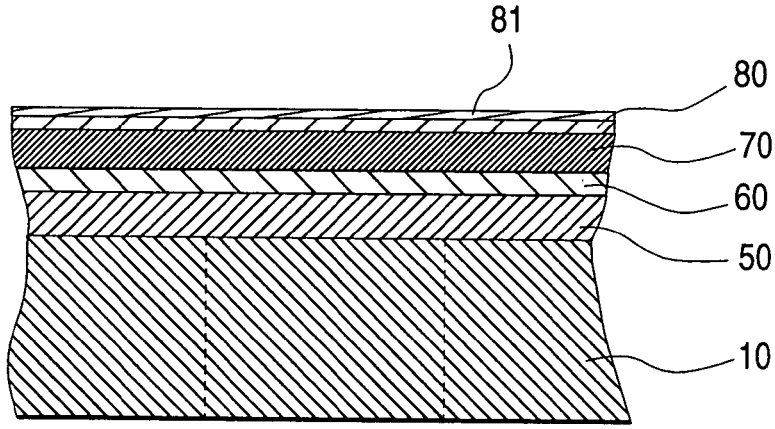

For example, as shown in FIG. 19*a,* any of the additives can be added to the upper electrode film 80 by ion implantation from above the upper electrode film 80 after the upper electrode film 80 is formed.

Figure 20:
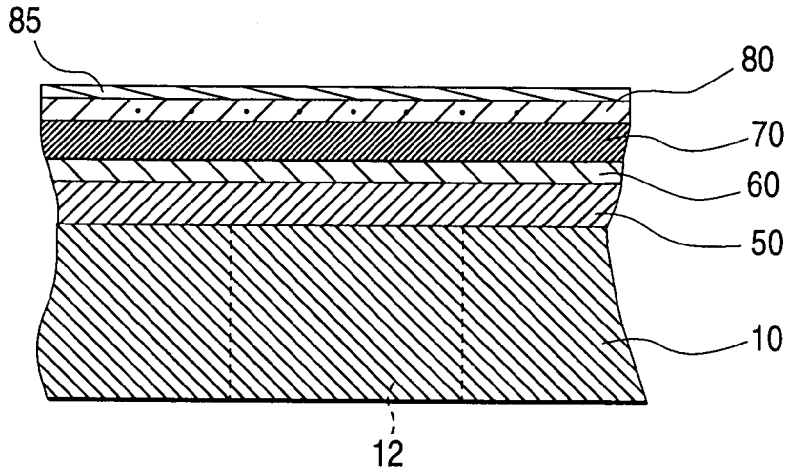
FIGS. 20(*a*)–20(*b*) are sectional views to show another manufacturing method of the upper electrode film according to the tenth embodiment of the invention.
Figure 20:
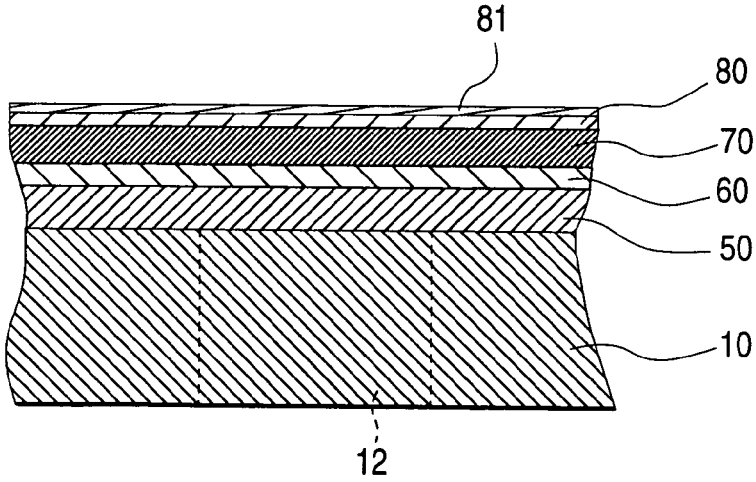

For example, as shown in FIG. 20*a,* any of the additives can also be added to the upper electrode film 80 by forming an additive layer 85 added to the upper electrode film 80 thereon and then heating in an inert gas or in vacuum, thereby solid-phase diffusing the constituent element of the additive layer 85 into the upper electrode film 80.

If an additive is thus added to the upper electrode film 80 by the ion implantation or solid-phase diffusion, it is added to an upper layer 81 of the upper electrode film 80, as shown in FIG. 19*b* or FIG. 20*b,* so that the upper layer 81 of the upper electrode film 80 has a particularly strong compressive stress.

Thus, an additive of metal, etc., different from the metal of the upper electrode film 80 is added to the upper electrode film 80, whereby the upper electrode film 80 is expanded in volume and thus becomes a compressive stress. Therefore, as in the first embodiment, the initial deflection amount of a diaphragm can be decreased, the deformation amount of the diaphragm by driving a piezoelectric active part 320 can be improved substantially. In the embodiment, the upper layer of the upper electrode film 80 is made to have a particularly strong compressive stress, so that the initial deflection amount of the diaphragm can be decreased effectively.

Figure 21:
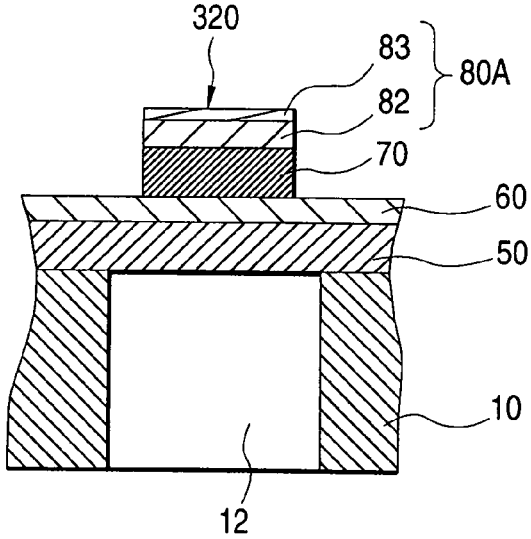
FIG. 21 is a sectional view of the main part of an ink jet recording head according to an eleventh embodiment of the invention.

FIG. 21 is a sectional view of the main part of an ink jet recording head according to an eleventh embodiment of the invention.

As shown in the figure, the eleventh embodiment is the same as the ninth embodiment except that an upper electrode film 80A is made up of a first electrode film 82 coming in contact with a piezoelectric film 70 and a second electrode film 83 deposited on the first electrode film 82.

The first electrode film 82 forming a part of the upper electrode film 80A in the eleventh embodiment is formed of any metal of platinum, palladium, iridium, rhodium, osmium, ruthenium, or rhenium and has a compressive stress as in the first embodiment. Preferably, the second electrode film 83 has a compressive stress stronger than the first electrode film 82 and is made of, for example, a conductive oxide film of ruthenium oxide, indium oxide tin, cadmium indium oxide, tin oxide, manganese oxide, rhenium oxide, iridium oxide, strontium ruthenium oxide, indium oxide, zinc oxide, titanium oxide, zirconium oxide, hafnium oxide, molybdenum oxide, etc., or, for example, a conductive nitride film of titanium nitride, niobium nitride, zirconium nitride, tungsten nitride, hafnium nitride, molybdenum nitride, tantalum nitride, chromium nitride, palladium nitride, etc.

A formation method of the upper electrode film 80A in the embodiment is not limited; in the embodiment, the upper electrode film 80A is formed according to the following method:

After a lower electrode film 60 and the piezoelectric film 70 are formed on a flow passage formation substrate 10 as in the thin film manufacturing process in the first embodiment, first the first electrode film 82 forming a part of the upper electrode film 80A is formed, next the second electrode film 83 having a major constituent different from that of the first electrode film 82 is formed thereon. Preferably, the second electrode film 83 is made of a conductive oxide film or a conductive nitride film; a conductive oxide or nitride film may be directly formed or may be formed by oxidation or nitriding after film formation.

Then, piezoelectric active part 320 and pressure generation chamber 12 are formed as in the above-described manufacturing process.

If the upper electrode film 80A is thus formed, the deformation amount of a diaphragm by driving the piezoelectric active part can be improved. The upper electrode film 80A is made up of the two layers each having a compressive stress and the upper layer of the upper electrode film 80A is formed of a conductive oxide film, a conductive nitride film, or the like, thereby creating a higher compressive stress than that of the lower layer, so that the initial deflection amount of the diaphragm can be suppressed effectively as in the tenth embodiment.

In the eleventh embodiment, the upper electrode film 80A is made up of the two layers, but may be formed of only the second electrode film 83 made of a conductive oxide film or a conductive nitride film without placing the first electrode film 82, for example. Also in the configuration, a similar advantage to that of the above-described embodiment can be provided.

Figure 22:
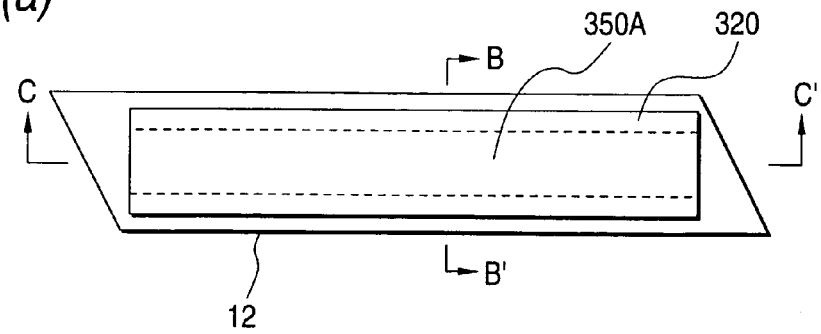
FIGS. 22(*a*)–22(*c*)' are plan and sectional views of the main part of an ink jet recording head according to a twelfth embodiment of the invention.
Figure 22:
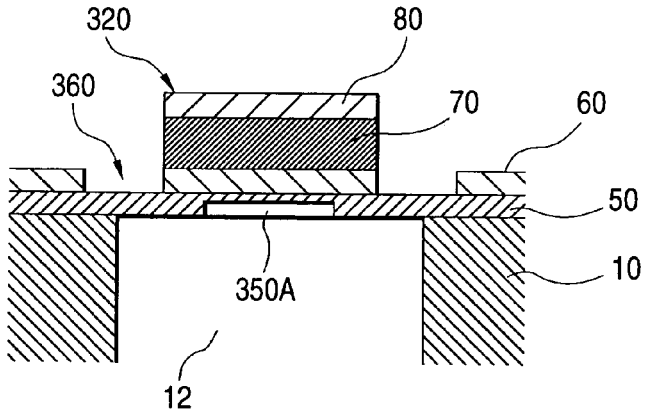
Figure 22:
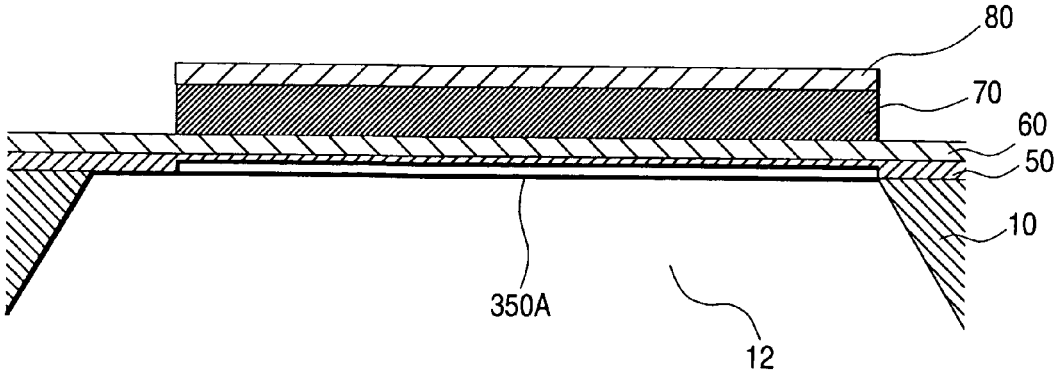

FIGS. 22(*a*)–22(*c*) are views to show the main part of an ink jet recording head according to a twelfth embodiment of the invention; FIG. 22*a* is a plan view, FIG. 22*b* is a sectional view taken on line B–B' in FIG. 22*a,* and FIG. 22*c* is a sectional view taken on line C–C' in FIG. 22*a.*

As shown in FIG. 22, the twelfth embodiment is the same as the seventh embodiment except that an elastic film removal part 350A is provided by removing a part of an elastic film 50 in the thickness direction thereof in a narrower width than a piezoelectric active part 320 over the length direction roughly in the center in the width direction of the area opposed to the piezoelectric active part 320 on the area side of the elastic film 50 opposed to a pressure generation chamber 12 and except that a lower electrode film 60 on both sides of the piezoelectric active part 320 in the width direction thereof is all removed.

Also in the configuration, a part of the compressive stress of the elastic film 50 is released by the elastic film removal part 350A and the initial deflection amount of a diaphragm can be decreased as in the above-described embodiment. Further, a force in the tension direction is given to a piezoelectric film 70 at the same time as the initial deflection amount of the diaphragm can be decreased, whereby the stress of the piezoelectric film 70 can be made equal to that at the film formation time or can be strengthened in the tension direction and the piezoelectric characteristic can be improved substantially.

Figure 23:
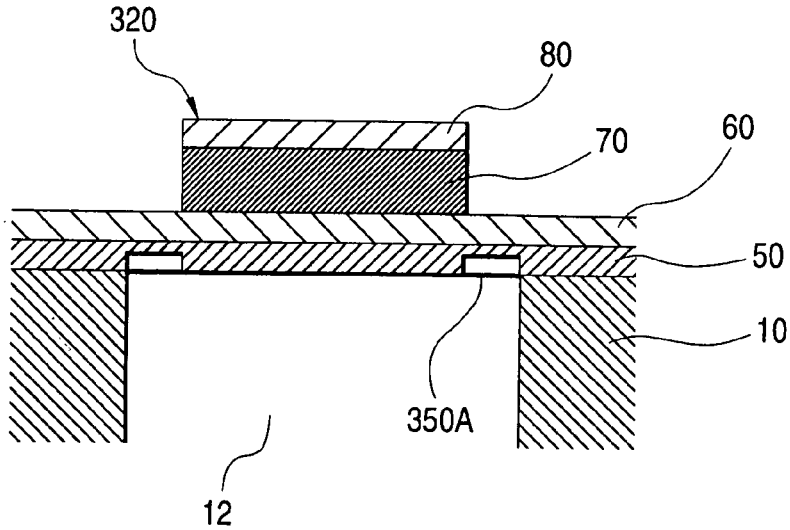
FIG. 23 is a sectional view to show a modified example of the ink jet recording head according to the twelfth embodiment of the invention.

In the embodiment, the elastic film removal part 350A is placed roughly in the center in the width direction of the elastic film 50 on the pressure generation chamber 12 side, but the invention is not limited to it. For example, as shown in FIG. 23, the elastic film removal part 350A may be placed on both sides of the elastic film 50 in the width direction thereof on the pressure generation chamber 12 side.

Also in the configuration, a part of the compressive stress of the elastic film 50 is released by the elastic film removal part 350A, the initial deflection amount of the diaphragm can be decreased, and the piezoelectric characteristic can be improved substantially as in the above-described embodiment.

In a thirteenth embodiment of the invention, a conductive film 65 made of a material substantially different from a lower electrode film 60 is further placed between the lower electrode film 60 and a piezoelectric film 70 and is a film having a compressive stress and the conductive film 65 on both sides of a piezoelectric active part 320 in the width direction thereof is removed to form a conductive film removal part 370. An elastic film 50 is a silicon dioxide film provided by oxidizing a surface of a flow passage formation substrate 10 made of a silicon monocrystalline substrate. The thirteenth embodiment is the same as the first embodiment in other points.

Figure 24:
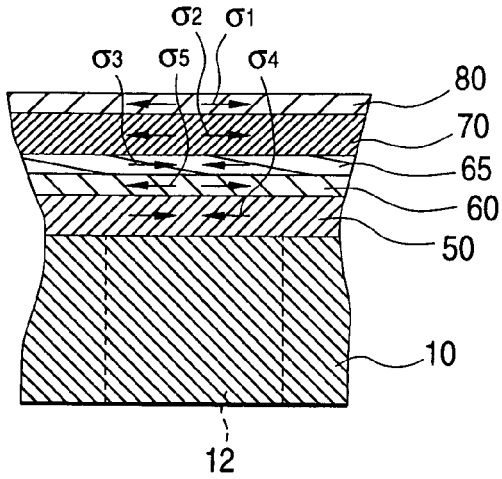
FIGS. 24(*a*)–24(*c*) are sectional views to show the state of stresses that a piezoelectric active part in a thirteenth embodiment of the invention receives at pressure generation chamber formation time.
Figure 24:
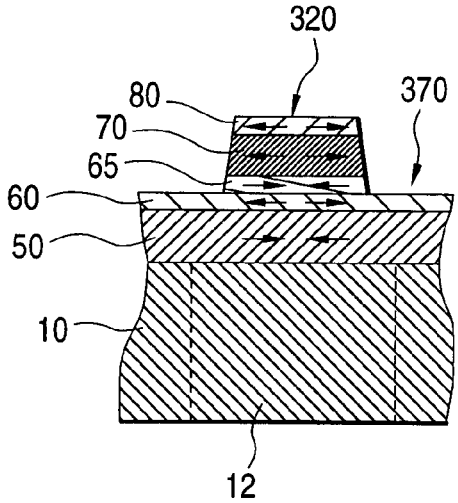
Figure 24:
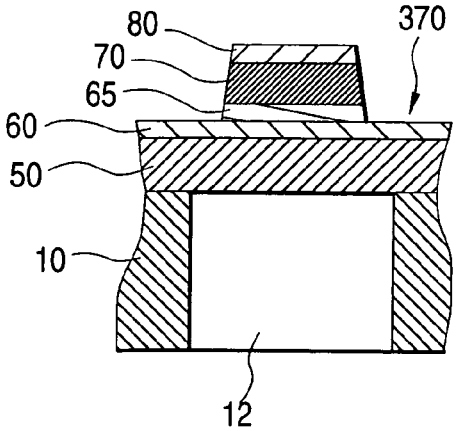

The state of stresses that the piezoelectric active part 320 in the embodiment receives will be discussed. FIGS. 24(*a*)–24(*c*) schematically show the state of a stress that each layer receives before and after pressure generation chambers 12 are formed by etching.

As shown in FIG. 24*a,* in a state in which the layers of the piezoelectric film 70, an upper electrode film 80, etc., are formed, the upper electrode film 80, the piezoelectric film 70, and the lower electrode film 60 receive tensile stresses $\sigma_1$, $\sigma_2$, and $\sigma_3$ from a flow passage formation substrate 10 and in the embodiment, the elastic film 50 and the conductive film 65 receive compressive stress $\sigma_4$ and $\sigma_5$. As shown in FIG. 24*b*, if the piezoelectric active parts 320 are patterned, parts of the tensile stresses $\sigma_1$ and $\sigma_2$ of the upper electrode film 80 and the piezoelectric film 70 are released and a part of the compressive stress $\sigma_5$ of the conductive film 65 is released. Next, as shown in FIG. 24*c,* if the pressure generation chamber 12 is formed below the piezoelectric active part 320, the stresses that the upper electrode film 80 and the piezoelectric film 70 receive from the flow passage formation substrate 10 are opposite in direction to the stress that the conductive film 65 receives therefrom. Thus, if the force of releasing the tensile stresses $\sigma_1$ and $\sigma_2$ of the upper electrode film 80 and the piezoelectric film 70 balances with the force of releasing the compressive stress $\sigma_5$ of the conductive film 65, deflection of a diaphragm made up of the lower electrode film 60 and the elastic film 50 little occurs.

Preferably, the conductive film 65 is a film receiving a compressive stress and having poor reactivity with the piezoelectric film 70 (preferably such a film with lead of PZT not diffused). Considering the conditions, preferably the conductive film 65 is a metal oxide film, specifically a film consisting essentially of any one of iridium oxide, rhenium oxide, or ruthenium oxide.

A manufacturing method of the conductive film 65 is not limited. After the lower electrode film 60 is formed, the conductive film 65 can be formed by the sol-gel method, for example, as in the above-described embodiment. Then, the piezoelectric film 70 and the upper electrode film 80 are formed, the piezoelectric active parts 320 are patterned, and the conductive film 65 on both sides of the piezoelectric active part 320 in the width direction thereof is patterned to form the conductive film removal part 370, thereby providing the configuration of the embodiment.

The measurement results of the diaphragm displacement amounts of the ink jet recording head of the embodiment and the conventional ink jet recording head are as follows:

The parameters in the layers of the ink jet recording head of the embodiment are as follows: The upper electrode film 80 is made of material of platinum and is 100 nm thick. The piezoelectric film 70 has a piezoelectric distortion constant of 150 pC/N and is 1000 nm thick. The upper electrode film 80 and the piezoelectric film 70 are 40 μm wide. The conductive film 65 is made of material of iridium oxide and is 0.7 μm thick. The lower electrode film 60 is made of material of platinum and is 0.2 μm thick. The elastic film 50 is 1.0 μm thick. The voltage applied to the piezoelectric film 70 is 25 V. The maximum displacement amount of the elastic film 50 was 195 nm under the conditions.

When the same compliance is applied in the related art (wherein the conductive film 65 is not provided) under the same conditions as above, the maximum displacement amount was 150 nm. Thus, the configuration of the embodiment can provide displacement 30% larger than that in the related art. That is, the initial deflection amount of the diaphragm is decreased reliably.

As described, according to the embodiment, as in the above-described embodiment, the initial deflection amount of the diaphragm can be decreased and further the durability when the diaphragm of the ink jet recording head is driven improves. In the embodiment, the conductive film 65 is placed between the lower electrode film 60 and the piezoelectric film 70. Thus, to etch the conductive film 65 until the lower electrode film 60 is exposed in the manufacturing process of the ink jet recording head, if an etching gas with a large etching selection ratio between the conductive film 65 and the lower electrode film 60 is selected appropriately, etching can be stopped under good control. For example, to use a plasma motor for etching, etching end point control is facilitated. Therefore, the manufacturing yield of the ink jet recording heads is enhanced and ink jet recording heads fitted to mass production can be provided, so that the manufacturing costs can be reduced.

In the embodiment, the conductive film 65 is formed of one layer, but the invention is not limited to it. For example, as shown in FIG. 24(*c*)', the conductive film 65 may be formed of two layers 65*a*, 65*b*. In this case, preferably each of the two layers has a compressive stress, but the invention is not limited to it; at least the upper layer 65*a* may have a compressive stress.

In the above-described embodiments, the diaphragm state after the pressure generation chamber 12 is formed is not shown; the stress state in each layer is optimized, whereby the diaphragm can be deformed upwardly convex, and the piezoelectric characteristic, etc., can be more improved.

In the embodiments wherein any layer is made a compressive film and its removal part is provided, a part of the arm of the elastic film 50 in the thickness direction thereof may be removed. According to the configuration, the elastic film 50 becomes easily deformed and becomes easily upwardly convex accordingly. At this time, the elastic film 50 may be a compressive stress or a tensile stress.

Figure 25:
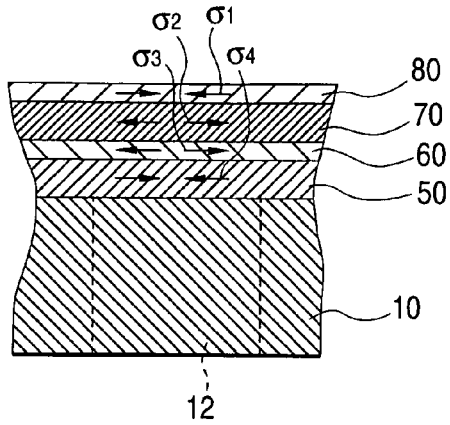
FIGS. 25(*a*)–25(*c*) are sectional views to show the state of stresses that a piezoelectric active part in a fourteenth embodiment of the invention receives at pressure generation chamber formation time.
Figure 25:
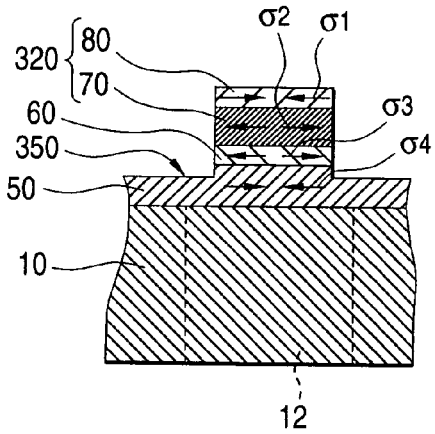
Figure 25:
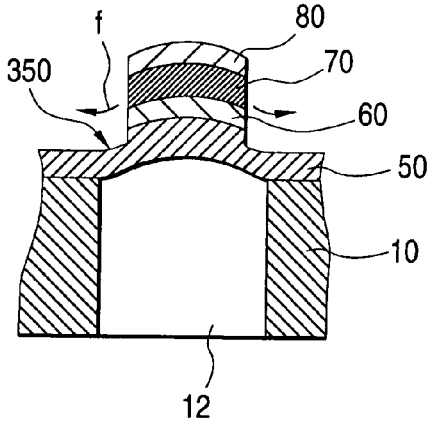

FIGS. 25(*a*)–25(*c*) show the stress state of a piezoelectric active part 320 in a fourteenth embodiment of the invention wherein an upper electrode film 80 and an elastic film 50 are compressive stresses and the elastic film 50 is formed in an arm with an elastic film removal part 350.

As shown in FIG. 25*a,* in a state in which the layers of a piezoelectric film 70 and the upper electrode film 80 are formed, the piezoelectric film 70 and the lower electrode film 60 receive tensile stresses $\sigma_2$ and $\sigma_3$ from a flow passage formation substrate 10 and the upper electrode film 80 and the elastic film 50 receive compressive stresses $\sigma_1$ and $\sigma_4$. In the embodiment, the magnitude of the compressive stress $\sigma_1$ of the upper electrode film 80 is larger than the magnitude of the tensile stress $\sigma_2$ and $\sigma_3$ of the piezoelectric film 70, the lower electrode film 60. It grows in the compression direction as the stress of the whole film. As shown in FIG. 25*b,* if the piezoelectric active parts 320 are patterned, parts of the stresses $\sigma_1$, $\sigma_2$, and $\sigma_3$ of the upper electrode film 80, the piezoelectric film 70, and the lower electrode film 60 are released. At the same time, a part of the stress $\sigma_4$ of the elastic film 50 is also released because a part of the elastic film 50 on both sides of the piezoelectric active part 320 in the width direction thereof is removed to form the elastic film removal part 350 in the embodiment. Next, as shown in FIG. 25*c*, if the pressure generation chamber 12 is formed below the piezoelectric active part 320, the stresses that the piezoelectric film 70 and the lower electrode film 60 receive from the flow passage formation substrate 10 are opposite in direction to the stresses that the upper electrode film 80 and the elastic film 60 receives therefrom, and the force of releasing a part of the compressive stress $\sigma_1$ of the upper electrode film 80 and a part of the compressive stress $\sigma_4$ of the elastic film 50 is larger than the force of releasing of the tensile stresses $\sigma_2$ and $\sigma_3$ of the piezoelectric film 70 and the lower electrode film 60, thus a diaphragm made of the elastic film 50 becomes deformed upwardly convex.

In the embodiment, the upper electrode film 80 is thus given the compressive stress of a predetermined magnitude or more. Thus, if the piezoelectric active parts 320 are patterned and the pressure generation chambers 12 are formed, the upper electrode film 80 receives a tensile stress (the compressive stress is released) and is offset with the stresses of the piezoelectric film 70 and the lower electrode film 60 in the compression direction and the diaphragm can be deformed upwardly convex. Particularly, in the embodiment, the elastic film 50 on both sides of the piezoelectric active part 320 in the width direction thereof is formed with the elastic film removal part 350 provided by removing a part in the thickness direction, so that the compliance of the diaphragm is improved and the diaphragm becomes more easily deformed upwardly convex. Therefore, the deformation amount of the diaphragm by driving the piezoelectric active part 320 can be improved remarkably.

In the embodiment, the elastic film 50 and the upper electrode film 80 are compression films having compressive stresses, but the invention is not limited to it. At least any of the lower electrode film 60, the upper electrode film 80, or a conductive film 65 formed on the lower electrode film 60 may be a compression film; of course, two or all of them may be compression films.

The embodiments of the invention have been described, but the basic configurations of the ink jet recording heads are not limited to those described above.

For example, in addition to the seal plate 20, the common ink chamber formation plate 30 may be made of glass ceramic and further the thin film 41 may be made of glass ceramic as a separate member; the material, structure, etc., can be changed as desired.

In the above-described embodiments, the nozzle openings are made in the end face of the flow passage formation substrate 10, but nozzle openings projecting in the vertical direction to a plane may be made.

Figure 26:
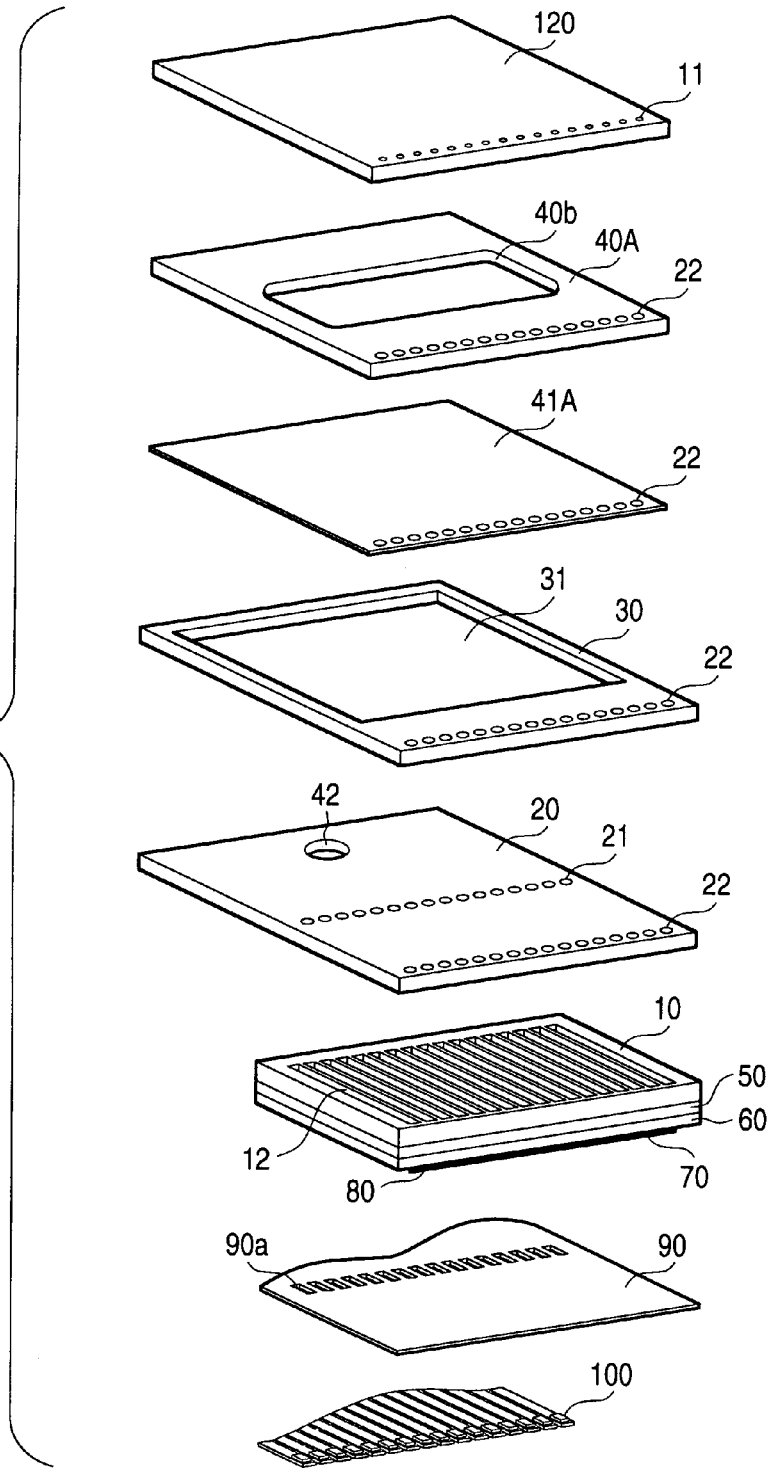
FIG. 26 is a perspective view showing an ink jet recording head according to another embodiment of the invention.
Figure 27:
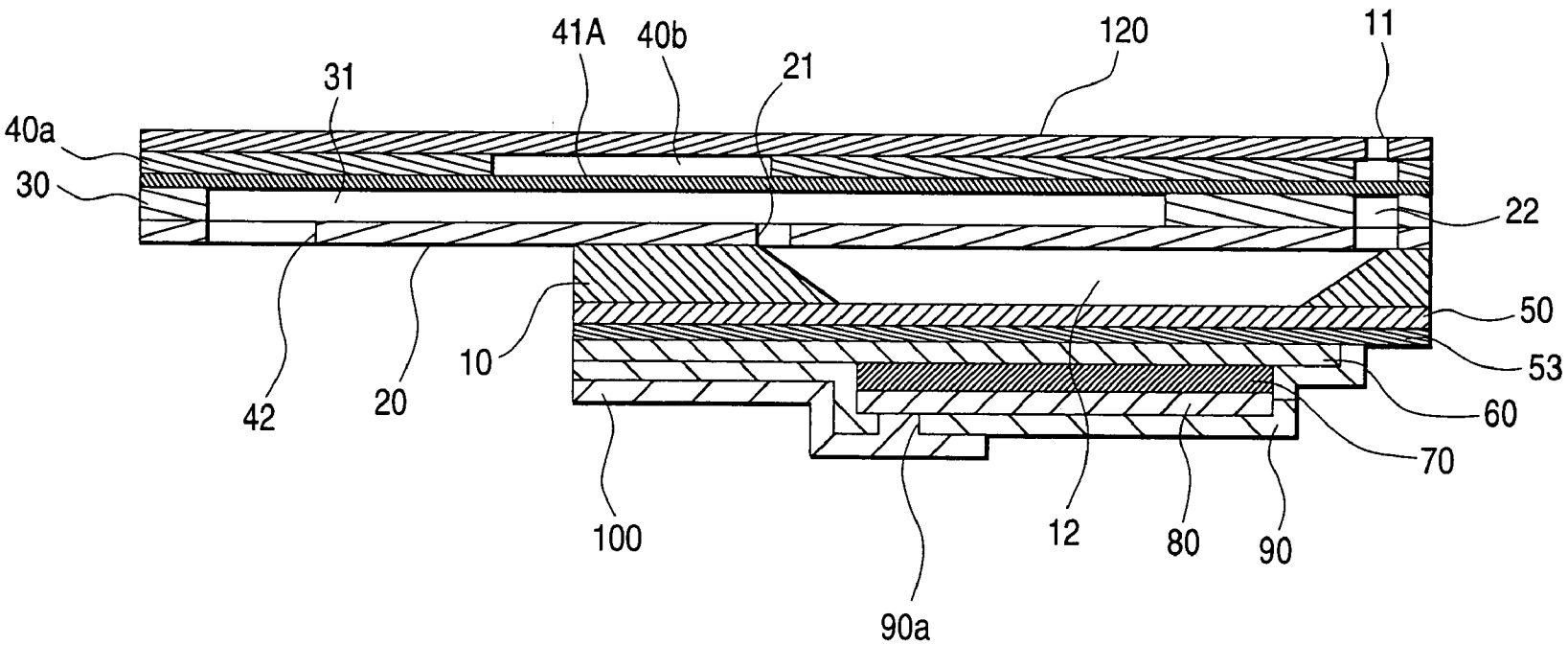
FIG. 27 is a sectional view showing the ink jet recording head according to the embodiment of the invention in FIG. 26.

FIG. 26 is an exploded perspective view of an embodiment thus configured and FIG. 27 is a sectional view of a flow passage in the embodiment. In the embodiment, nozzle openings 11 are made in a nozzle substrate 120 opposite to a piezoelectric element and nozzle communication ports 22 for allowing the nozzle openings 11 and pressure generation chambers 12 to communicate with each other are disposed so as to pierce a seal plate 20, a common ink chamber formation plate 30, a thin plate 41A, and an ink chamber side plate 40A In addition, the thin plate 41A and the ink chamber side plate 40A are made separate members and the ink chamber side plate 40A is formed with an opening 40*b*. The embodiment is basically similar to the above-described embodiment in other points. Parts identical with those previously described with reference to the figures are denoted by the same reference numerals in FIG. 26 and FIG. 27 and will not be discussed again.

Of course, the embodiment can also be applied to the ink jet recording head of the type wherein a common ink chamber is formed in a flow passage formation substrate.

In the above-described embodiments, the thin-film ink jet recording heads that can be manufactured by applying film formation and lithography process are taken as examples, but the invention is not limited to them, of course. The invention can be applied to ink jet recording heads of various structures, such as a structure wherein substrates are deposited to form pressure generation chambers and a structure wherein a green sheet is put or screen printing, etc., is executed to form a piezoelectric film.

In the description, the insulating layer is placed between the piezoelectric element and the lead electrode, but the invention is not limited to it. For example, without providing the insulating layer, an anisotropic conductive film is thermally attached onto each upper electrode and is connected to a lead electrode or various bonding techniques such as wire bonding may be used for connection.

Thus, the invention can be applied to ink jet recording heads of various structures without departing from the spirit and scope of the invention.

Figure 28:
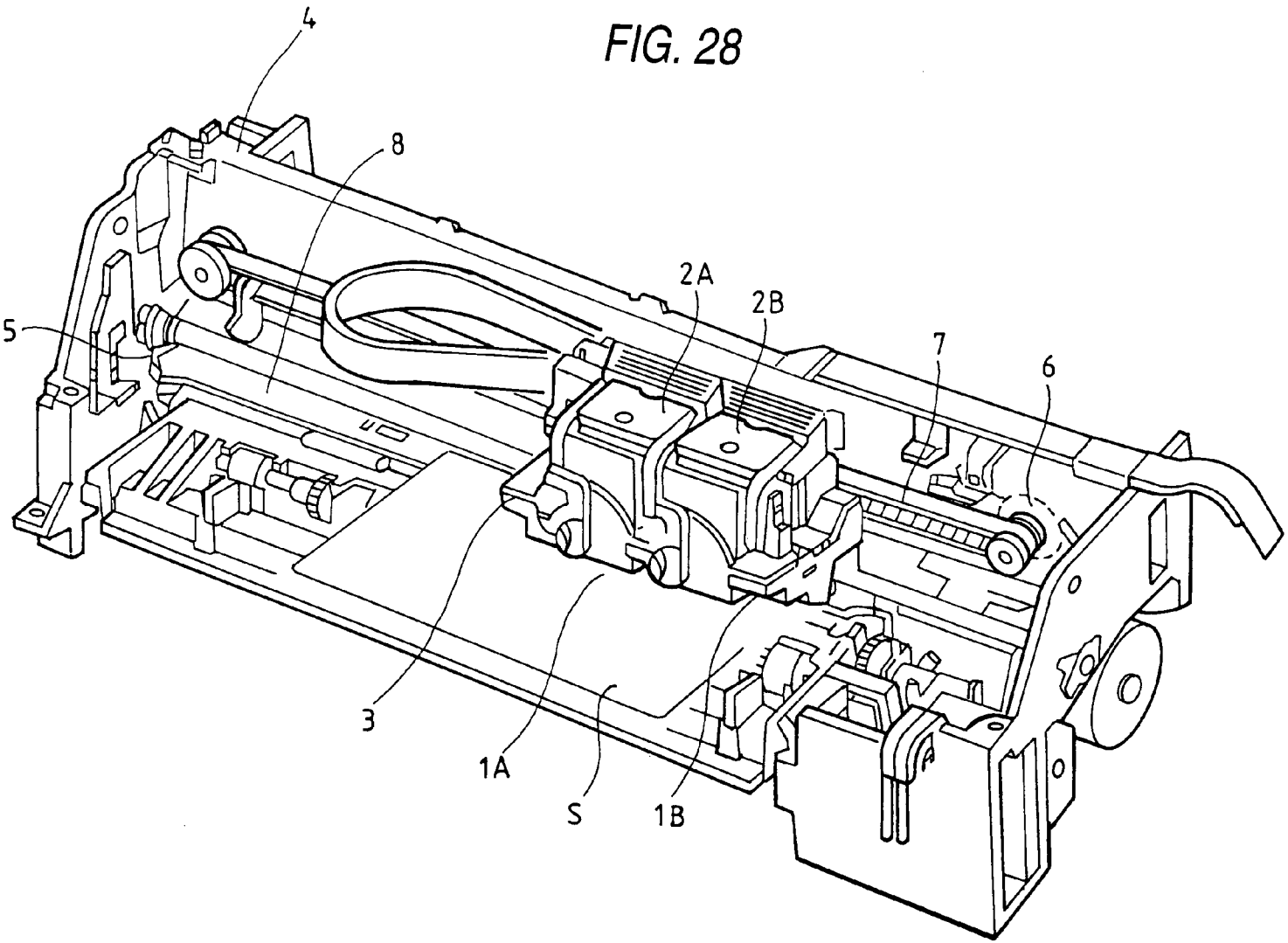
FIG. 28 is a schematic diagram showing an ink jet recorder according to one embodiment of the invention.

Each of the ink jet recording heads of the embodiments forms a part of a recording head unit comprising an ink flow passage communicating with an ink cartridge, etc., and is installed in an ink jet recorder. FIG. 28 is a schematic diagram to show an example of the ink jet recorder.

As shown here, cartridges 2A and 2B forming ink supply means are detachably placed in recording head units 1A and 1B each having an ink jet recording head, and a carriage 3 on which the recording head units 1A and 1B are mounted is placed axially movably on a carriage shaft 5 attached to a recorder main body 4. The recording head units 1A and 1B jet a black ink composite and a color ink composite respectively, for example.

A driving force of a drive motor 6 is transmitted to the carriage 3 via a plurality of gears and a timing belt (not shown), whereby the carriage 3 on which the recording head units 1A and 1B are mounted is moved along the carriage shaft 5. On the other hand, the recorder main body 4 is provided with a platen 8 along the carriage shaft 5 and a recording sheet S of a recording medium such as paper fed by a paper feed roller, etc., (not shown) is wrapped around the platen 8 and is transported.

As described above, according to the invention, the film having a compressive stress is formed on the elastic film side of the flow passage formation substrate and at least a part of the portion of the film corresponding to the arm of the diaphragm is removed. Thus, a part of the compressive stress is released and if the pressure generation chambers are patterned, deflection of the diaphragm can be reduced. If only a small deflection of the diaphragm occurs, the piezoelectric characteristic of the piezoelectric film before the pressure generation chambers are formed can be maintained and substantially improved and the displacement efficiency of the head can be enhanced.

What is claimed is:

1. In an ink jet recording head of the type having a flow passage formation substrate in which a pressure generation chamber is formed, said pressure generation chamber being in communication with a nozzle opening, a diaphragm provided on said flow passage formation substrate, said diaphragm defining an interior wall of said pressure generation chamber, and a piezoelectric element provided on said diaphragm, said piezoelectric element having at least a lower electrode, a piezoelectric layer, and an upper electrode, the improvement comprising:

at least one of the group consisting of said diaphragm and said piezoelectric element, includes a compression film having a compressive stress, wherein at least a part of a thickness of said compression film is removed in an area opposed to said pressure generation chamber, thereby forming a removal part, and further wherein said lower electrode includes a tensile stress.

2. The ink jet recording head as claimed in claim 1 wherein the compression film is other than the piezoelectric layer.

3. The ink jet recording head as claimed in claim 1, wherein the compression film has at least a part in the thickness direction removed only in a portion along margins of the pressure generation chamber on both sides of said piezoelectric element in a width direction thereof.

4. The ink jet recording head as claimed in claim 1, wherein the compression film is a conductive film being placed between the lower electrode and the piezoelectric layer and made of a material substantially different from that of the lower electrode.

5. The ink jet recording head as claimed in claim 4, wherein the conductive film is a film containing a second conductive film formed on the lower electrode and a first conductive film formed on the second conductive film and at least the second conductive film is a film made of a material different from that of the lower electrode.

6. The ink jet recording head as claimed in claim 5 wherein the second conductive film is a film comprising either platinum or iridium.

7. The ink jet recording head as claimed in claim 5, wherein the second conductive film is a metal oxide film.

8. The ink jet recording head as claimed in claim 7, wherein the first conductive film is a film formed of a material for preventing lead contained in the piezoelectric layer from diffusing.

9. The ink jet recording head as claimed in claim 7, wherein the second conductive film comprises any of iridium oxide, rhenium oxide, or ruthenium oxide.

10. The ink jet recording head as claimed in claim 1, wherein the compression film forms at least a part of an elastic film forming at least a part of the diaphragm.

11. The ink jet recording head as claimed in claim 10 wherein at least the residue of the compression film forming a part of the elastic film is made of a polycrystalline substance.

12. The ink jet recording head as claimed in claim 11, wherein the elastic film is made of the compression film only.

13. The ink jet recording head as claimed in claim 11, wherein the elastic film is made of a film of multiple layers and at least the top layer is the compression film.

14. The ink jet recording head as claimed in claim 13, wherein the compression film forming the elastic film is made of metal oxide.

15. The ink jet recording head as claimed in claim 14 wherein the compression film is made of zirconium oxide or hafnium oxide and has a crystal structure of a monoclinic system.

16. The ink jet recording head as claimed in claim 14, wherein the metal oxide is selected from ruthenium oxide, indium oxide tin, cadmium indium oxide, tin oxide, manganese oxide, rhenium oxide, iridium oxide, strontium ruthenium oxide, indium oxide, zinc oxide, titanium oxide, zirconium oxide, tantalum oxide, hafnium oxide, osmium oxide, rhodium oxide, palladium oxide, and molybdenum oxide, and compounds thereof.

17. The ink jet recording head as claimed in claim 16, wherein layers formed of the metal oxide and the metal nitride are formed by oxidation or nitriding after film formation.

18. The ink jet recording head as claimed in claim 13, wherein a layer below the compression film is a layer made of a material different from the compression film in etching characteristic and is not selectively etched.

19. The ink jet recording head as claimed in claim 18, wherein the not selectively etched layer below the compression film is selected from metal, stabilization or partial stabilization zirconium oxide, and stabilization or partial stabilization hafnium oxide.

20. The ink jet recording head as claimed in claim 13, wherein the elastic film contains a silicon dioxide film or a boron-doped silicon film on the pressure generation chamber side.

21. The ink jet recording head as claimed in claim 10, wherein the lower electrode is made of a film having a tensile stress and is thinner than the compression film of the portion with at least a part removed.

22. The ink jet recording head as claimed in claim 10, wherein the elastic film forming at least a part of the diaphragm has at least a part in a thickness direction removed in an area which is opposed to the pressure generation chamber and is other than the piezoelectric layer.

23. The ink jet recording head as claimed in claim 22 wherein the elastic film has at least a part in the thickness direction removed only in a portion along the margins of the pressure generation chamber on both sides of said piezoelectric element in the width direction thereof.

24. The ink jet recording head as claimed in claim 22, wherein said piezoelectric element is formed on the elastic film so as to extend to the portion with at least a part of the elastic film removed.

25. The ink jet recording head as claimed in claim 24 wherein the piezoelectric layer forming said piezoelectric element is roughly uniformly thick.

26. The ink jet recording head as claimed in claim 24 wherein an end of the extension of the piezoelectric layer forming said piezoelectric element to the portion with the part of the elastic film removed is thicker than other portions.

27. The ink jet recording head as claimed in claim 22, wherein at least a part of the piezoelectric layer is formed across an area opposed to the pressure generation chamber and said piezoelectric element is formed by patterning only the upper electrode or the upper electrode and a part of the piezoelectric layer in a thickness direction thereof.

28. The ink jet recording head as claimed in claim 22, wherein the lower electrode is placed uniformly in an area opposed to said piezoelectric element and in other areas.

29. The ink jet recording head as claimed in claim 1 wherein the lower electrode is made of a metal material.

30. The ink jet recording head as claimed in claim 29, wherein the metal material is selected from platinum, palladium, iridium, rhodium, osmium, ruthenium, and rhenium, and compounds thereof.

31. The ink jet recording head as claimed in claim 1 wherein the lower electrode is made of metal oxide.

32. The ink jet recording head as claimed in claim 1 wherein the lower electrode is made of metal nitride.

33. The ink jet recording head as claimed in claim 32, wherein the metal nitride is selected from titanium nitride, niobium nitride, zirconium nitride, tungsten nitride, hafnium nitride, molybdenum nitride, tantalum nitride, chromium nitride, and palladium nitride, and compounds thereof.

34. The ink jet recording head as claimed in claim 1, wherein the lower electrode on both sides of the piezoelectric layer in a width direction thereof is completely removed.

35. The ink jet recording head as claimed in claim 1, wherein the upper electrode is formed of the compression film and is patterned together with the piezoelectric layer.

36. The ink jet recording head as claimed in claim 35 wherein the upper electrode made of the compression film has a compressive stress at least after said piezoelectric element is patterned.

37. The ink jet recording head as claimed in claim 36 wherein the upper electrode comprises a metal material.

38. The ink jet recording head as claimed in claim 37 wherein the upper electrode made of the compression film is formed by a sputtering method and a predetermined gas is added into the metal material, whereby the upper electrode becomes a compressive stress.

39. The ink jet recording head as claimed in claim 38 wherein the predetermined gas is an inert gas selected from helium, neon, argon, krypton, xenon, and radon.

40. The ink jet recording head as claimed in claim 37 wherein at least one additive selected from metal, semimetal, semiconductor, and insulator different in constituent is added into the metal material, whereby the upper electrode made of the compression film becomes a compressive stress.

41. The ink jet recording head as claimed in claim 40 wherein the additive is added to the upper electrode by executing ion implantation.

42. The ink jet recording head as claimed in claim 40 wherein the additive is added to the upper electrode by executing solid-phase diffusion from a layer placed on the upper electrode.

43. The ink jet recording head as claimed in claim 42 wherein the solid-phase diffusion is executed by heating in an insert gas or in vacuum.

44. The ink jet recording head as claimed in claim 35, wherein the upper electrode has a first electrode formed on a surface of the piezoelectric layer and a second electrode deposited on the first electrode and the second electrode is a film made of metal oxide or metal nitride.

45. The ink jet recording head as claimed in claim 44 wherein the first electrode comprises a metal material.

46. The ink jet recording head as claimed in claim 1, wherein the diaphragm is deformed convex outwardly from the pressure generation chamber.

47. The ink jet recording head as claimed in claim 1, wherein a stress of the piezoelectric layer when a drive force load is imposed on said piezoelectric element is equal to a stress at the piezoelectric layer formation time or is larger in a tension direction.

48. The ink jet recording head as claimed in claim 47 wherein said piezoelectric element in the area opposed to the pressure generation chamber is bent convex to the piezoelectric layer side when the pressure generation chamber is formed.

49. The ink jet recording head as claimed in claim 47, wherein an expansion force of a portion of the diaphragm opposed to said piezoelectric element in the area opposed to the pressure generation chamber is relatively smaller to the compression side than an expansion force in other than the area opposed to said piezoelectric element.

50. The ink jet recording head as claimed in any one of claims 1 to 20, 29 to 49 wherein the pressure generation chambers are formed on a silicon monocrystalline substrate by anisotropic etching and the layers of said piezoelectric element are formed by film forming and lithography process.

51. An ink jet recorder comprising an ink jet recording head as claimed in any one of claims 1 to 20, 29 to 49.

52. The ink jet recording head as claimed in claim 1, wherein said compression film is an elastic film and said lower electrode film is formed uniformly on said elastic film without patterning.

53. The ink jet recording head as claimed in claim 1, wherein ends of said piezoelectric element are extended to an area opposite to said removal part.

54. The ink jet recording head as claimed in claim 1, wherein said upper electrode is said compression film.

55. The ink jet recording head as claimed in claim 1, wherein said compression film includes said compressive stress pre-established therein.

56. The ink jet recording head as claimed in claim 4, wherein said conductive film is a metal oxide film.

57. The ink jet recording head as claimed in claim 4, wherein said conductive film is a film formed of a material for preventing lead contained in the piezoelectric layer from diffusing.

58. The ink jet recording head as claimed in claim 57, wherein said material for preventing lead contained in the piezoelectric layer from diffusing is selected from iridium, iridium oxide, ruthenium oxide and rhenium oxide.

* * * * *

UNITED STATES PATENT AND TRADEMARK OFFICE

CERTIFICATE OF CORRECTION

PATENT NO. : 7,101,026 B2
APPLICATION NO. : 09/199816
DATED : September 5, 2006
INVENTOR(S) : Masato Shimada It is certified that error appears in the above-identified patent and that said Letters Patent is hereby corrected as shown below:

On the Title page, item [75] should read:
Inventors: Masato Shimada, Nagano (JP);
Shinri Sakai, Nagano (JP);
Shiro Yazaki, Nagano (JP)

Signed and Sealed this

First Day of July, 2008

JON W. DUDAS
*Director of the United States Patent and Trademark Office*